US005707183A

United States Patent [19]

Akamine

[11] Patent Number: 5,707,183

[45] Date of Patent: Jan. 13, 1998

[54] BLOCK FOR A RETENTION WALL OF LEANING TYPE, RETAINING WALL CONSTRUCTED WITH BLOCKS THEREFOR, AND METHODS FOR THE PREPARATION AND CONSTRUCTION THEREOF

[75] Inventor: Masumi Akamine, Kumamoto, Japan

[73] Assignee: Masu Kozokikaku Co., Ltd., Kumamoto, Japan

[21] Appl. No.: 572,549

[22] Filed: Dec. 14, 1995

[30] Foreign Application Priority Data

Dec. 14, 1994 [JP] Japan ..... 6-311018
Sep. 28, 1995 [JP] Japan ..... 7-251584

[51] Int. Cl.[6] ..... E02D 29/02

[52] U.S. Cl. ..... 405/284; 405/288

[58] Field of Search ..... 405/284, 288

[56] References Cited

U.S. PATENT DOCUMENTS 4,426,176 1/1984 Terada ..... 405/286 X
4,684,294 8/1987 O'Neill ..... 405/286
5,468,098 11/1995 Babcock ..... 405/284 X

FOREIGN PATENT DOCUMENTS 54-100104 8/1979 Japan .
358069935 4/1983 Japan ..... 405/284
405125739 5/1993 Japan ..... 405/286

*Primary Examiner*—Carl D. Friedman
*Assistant Examiner*—Yvonne Horton-Richardson
*Attorney, Agent, or Firm*—Foley & Lardner

[57] ABSTRACT

A block for retaining wall of a leaning type includes a front wall disposed with an upper portion thereof located behind a lower portion thereof so as to lean gradually in a backward direction, a partition wall having a length as substantially long as a vertical length of a rear wall portion of the front wall and extending backward, and a bottom plate connected integrally to a bottom portion of the front wall and extending backward. At least either of the front wall or said partition wall is provided with an opening which extends vertically over an entire length of said partition wall and into which an iron bar or rod is disposed.

12 Claims, 28 Drawing Sheets

BLOCK FOR A RETENTION WALL OF LEANING TYPE, RETAINING WALL CONSTRUCTED WITH BLOCKS THEREFOR, AND METHODS FOR THE PREPARATION AND CONSTRUCTION THEREOF

BACKGROUND OF THE INVENTION

1. Field of the Invention

The present invention relates to a block for a retention wall of a leaning type, a retaining wall constructed with blocks therefor, and methods for the preparation and construction of the same.

2. Description of the Related Art

It has heretofore been claimed that a retaining wall of a leaning type should have a negative moment, as represented by −M, to be caused by a leaning force of the retaining wall or by other force larger than a positive fall-down force, as represented by Mo, to be caused by an earth load on a rear side of the retaining wall and that it should have a fall-down safety factor, as represented by Fs, be equal to or larger than 1.5 in a usual case. The negative moment −M is usually represented as a resisting moment Mr and the resisting moment Mr in turn should be equal to or larger than 1.5.

Therefore, if a retaining wall of a type as described herein would have a resisting moment Mr equal to or larger than 1.5, it is not required to have any reinforcing steel bar as a tensile steel bar disposed on either of its front side or its rear side. Nevertheless, when retaining walls are built at locations, for example, where ground conditions are not good or drainage conditions are poor, some troubles with such retaining walls have been caused and, in some cases, such retaining walls have been caused to collapse.

In many cases of the troubles, the retaining walls are caused to be curved forward at their middle portions or at their portions higher by one third from their bases while they are caused to be curved rearward at their portions higher than the upward curved portions. Due to these causes, the retaining walls are caused to crack at the curved portions or to collapse. These troubles may be caused by the cause that the retaining walls undergo a positive bending moment at their lower portions while a negative bending moment at their upper portions, whereby the front sides of the retaining walls undergo a maximum tension. If a retaining wall would be of no tensile structure without having any reinforcement steel bar or rod disposed as a tensile bar at its front side, it cannot withstand the maximum tension applied to its front side and, in worst cases, it may be caused to collapse, for example, due to earthquake or a heavy rain fall.

SUMMARY OF THE INVENTION

Therefore, the present invention has the object to provide a block of a retaining wall of a leaning type having a front wall and a retaining wall disposed integrally with the front wall so as to protrude rearward from a retaining wall side, which is constructed with blocks laid onto another row of blocks forming a vertical aperture for insertion of a reinforcement steel bar or rod and that is less likely to cause troubles as described hereinabove and to be caused to collapse.

The present invention has another object to provide a retaining wall constructed with the blocks according to the present invention.

The present invention has a further object to provide a method for the preparation of the block according to the present invention.

The present invention has a still further object to provide a method for constructing a retaining wall by laying a row of blocks on another row of blocks so as to form an aperture or opening into which a reinforcement steel bar or rod is inserted.

In order to achieve the objects as described hereinabove, the present invention provides a block for retaining wall of a leaning type comprising a front wall and a partition wall disposed integrally with the front wall and projecting backward from a rear wall surface of the front wall; wherein the front wall is provided with an opening extending vertically over its entire length in a position located ahead of the partition wall.

Further, the present invention provides the block therefor, wherein the partition wall is provided with an opening extending vertically over its entire length.

In addition, there is provided the block therefor which further comprises a bottom plate extending backward in an approximately horizontal direction from a bottom portion of the rear wall of the front wall and disposed integrally with the rear wall of the front wall.

The present invention further provides the block therefor, wherein the front wall is disposed with its upper portion leaning backward so as to be located in a position behind of its lower portion.

Furthermore, the present invention provides the block for a retaining wall of a leaning type comprising a front wall disposed with an upper portion thereof located behind of a lower portion thereof so as to lean gradually in a backward direction, a partition wall having a length as substantially long as a vertical length of a rear wall portion of the front wall and extending backward, and a bottom plate connected integrally to a bottom portion of the front wall and extending backward; wherein at least either of the front wall or the partition wall is provided with an opening which extends vertically over an entire length of the partition wall and into which an iron bar or rod is disposed.

The present invention further provides the block in which the partition wall is provided with a plurality of openings each of which extends vertically over an entire length of the partition wall and into which an iron bar or rod is disposed.

There is also provided the block therefor, in which an iron bar or rod is disposed inside the front wall in each of vertical and transverse directions; an iron bar or rod is disposed inside the partition wall in each of vertical and transverse directions so as to enclose the opening disposed in the partition wall; and an iron bar or rod is disposed inside the front wall in each of vertical and transverse directions.

Further, the present invention provides the block in which an iron bar or rod is disposed inside the front wall in each of vertical and transverse directions; an iron bar or rod is disposed inside the partition wall in each of vertical and transverse directions so as to enclose the plurality of the openings disposed in the partition wall; and an iron bar or rod is disposed inside the front wall in each of vertical and transverse directions.

In addition, the present invention provides the block in which a top edge of the partition wall is connected to the rear wall of the front wall in a position lower than a top edge of the rear wall thereof to form a top step portion; a front edge portion of the bottom plate is connected to the rear wall of the front wall so as to project downward from a bottom edge of the front wall to form a bottom step portion; and the top portion is in such a shape as substantially adapting to and agreeing with the bottom portion.

Furthermore, the present invention provides the block therefor, in which the front wall has its left-hand and right-hand sides tapered backward so as to become gradually narrower in width from its front edge to its rear edge.

Still further, the present invention provides the block therefor, in which the bottom plate has its left-hand and right-hand sides tapered backward so as to become gradually narrower in width from its front edge to its rear edge.

Further, there is provided the retaining wall of a leaning type comprising a plurality of rows of blocks, each block comprising a front wall disposed with an upper portion thereof located behind of a lower portion thereof so as to lean gradually in a backward direction, a partition wall having a length as substantially long as a vertical length of a rear wall portion of the front wall and extending backward, and a bottom plate connected integrally to a bottom portion of the front wall and extending backward; in which at least either of the front wall or the partition wall is provided with an opening which extends vertically over an entire length of the partition wall and into which an iron bar or rod is disposed; an iron bar or rod is disposed inside the front wall in each of vertical and transverse directions; an iron bar or rod is disposed inside the partition wall in each of the vertical and transverse directions so as to enclose the plurality of the openings disposed in the partition wall; and an iron bar or rod is disposed inside the front wall in each of vertical and transverse directions.

Additionally, the present invention provides a method for the preparation of a block having a front wall disposed with an upper portion thereof located behind of a lower portion thereof so as to lean gradually in a backward direction, a partition wall having a length as substantially long as a vertical length of a rear wall portion of the front wall and extending backward, and a bottom plate connected integrally to a bottom portion of the front wall and extending backward; in which at least either of the front wall or the partition wall is provided with an opening which extends vertically over an entire length of the partition wall and into which an iron bar or rod is disposed; an iron bar or rod is disposed inside the front wall in each of vertical and transverse directions; an iron bar or rod is disposed inside the partition wall in each of vertical and transverse directions so as to enclose the plurality of the openings disposed in the partition wall; and an iron bar or rod is disposed inside the front wall in each of vertical and transverse directions; comprising:

the step of pouring a partial amount of a material structuring the block into a mold;

the step of disposing the iron bar or rod in the material; and the step of pouring another partial amount of the material into the mold.

Further, the present invention provides a method for the construction of a retaining wall of a leaning type with a plurality of rows of blocks, each block having a front wall disposed with an upper portion thereof located behind of a lower portion thereof so as to lean gradually in a backward direction, a partition wall having a length as substantially long as a vertical length of a rear wall portion of the front wall and extending backward, and a bottom plate connected integrally to a bottom portion of the front wall and extending backward; wherein at least either of the front wall or the partition wall is provided with an opening which extends vertically over an entire length of the partition wall and into which an iron bar or rod is disposed; comprising:

the step of forming a footing foundation at a construction site where the retaining wall is constructed;

the step of laying a lowest row of the blocks onto an upper rear surface of the footing foundation;

the step of laying an upper row of the blocks onto the lowest row of the blocks;

the step of laying another upper row of the blocks onto the lower row of the blocks; and the step of laying a further row of the blocks onto the lower row of the blocks one by another for form the retaining wall.

Other objects, features and advantages of the present invention will become apparent in the course of the description that follows, with reference to the accompanying drawings.

DESCRIPTION OF THE PREFERRED EMBODIMENTS

The present invention will be described in more details by way of examples with reference to the accompanying drawings.

Figure 1:
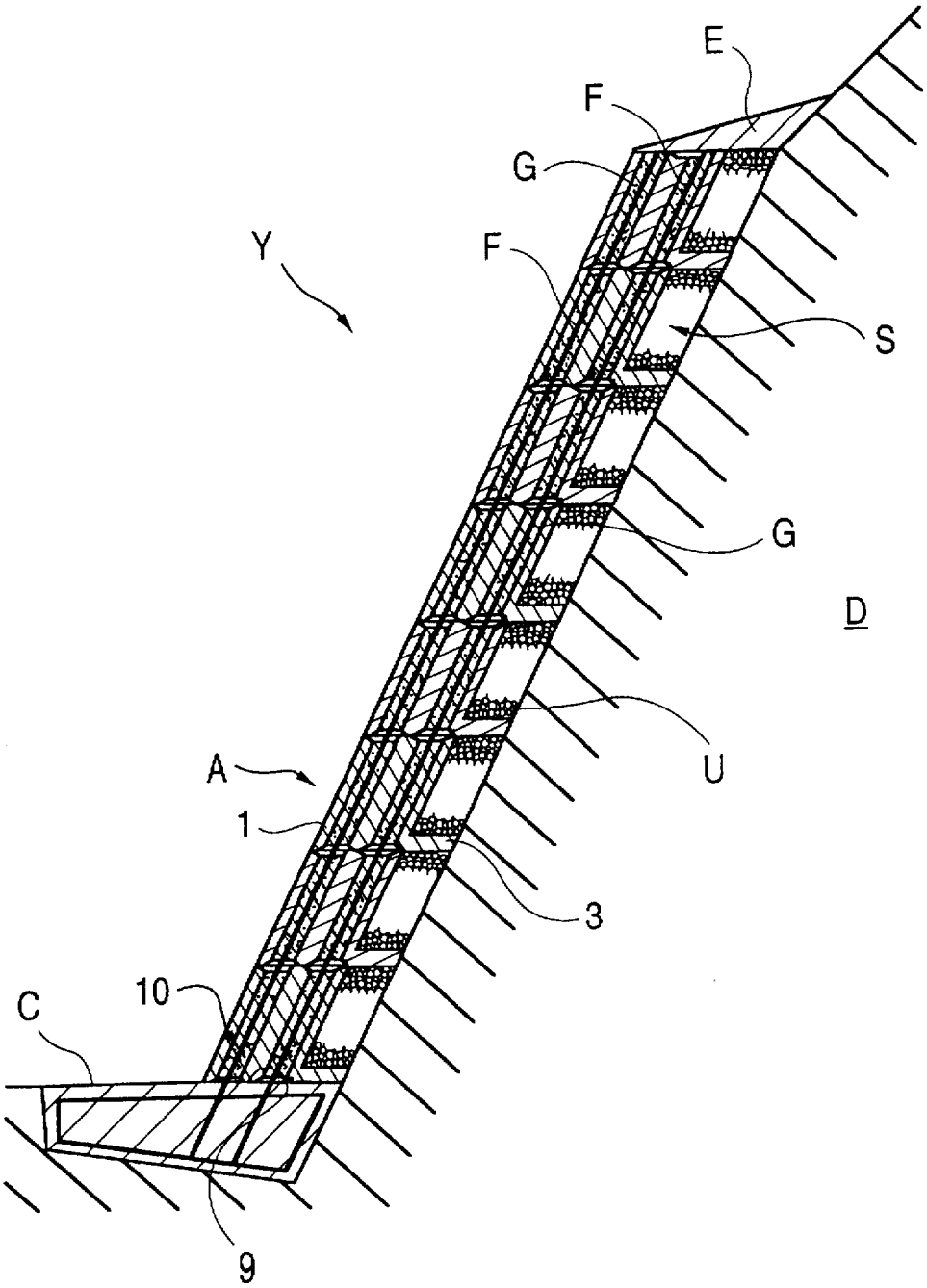
FIG. 1 is a side view in section showing a retaining wall of a leaning type constructed with blocks in accordance with a first embodiment of the present invention.
Figure 2:
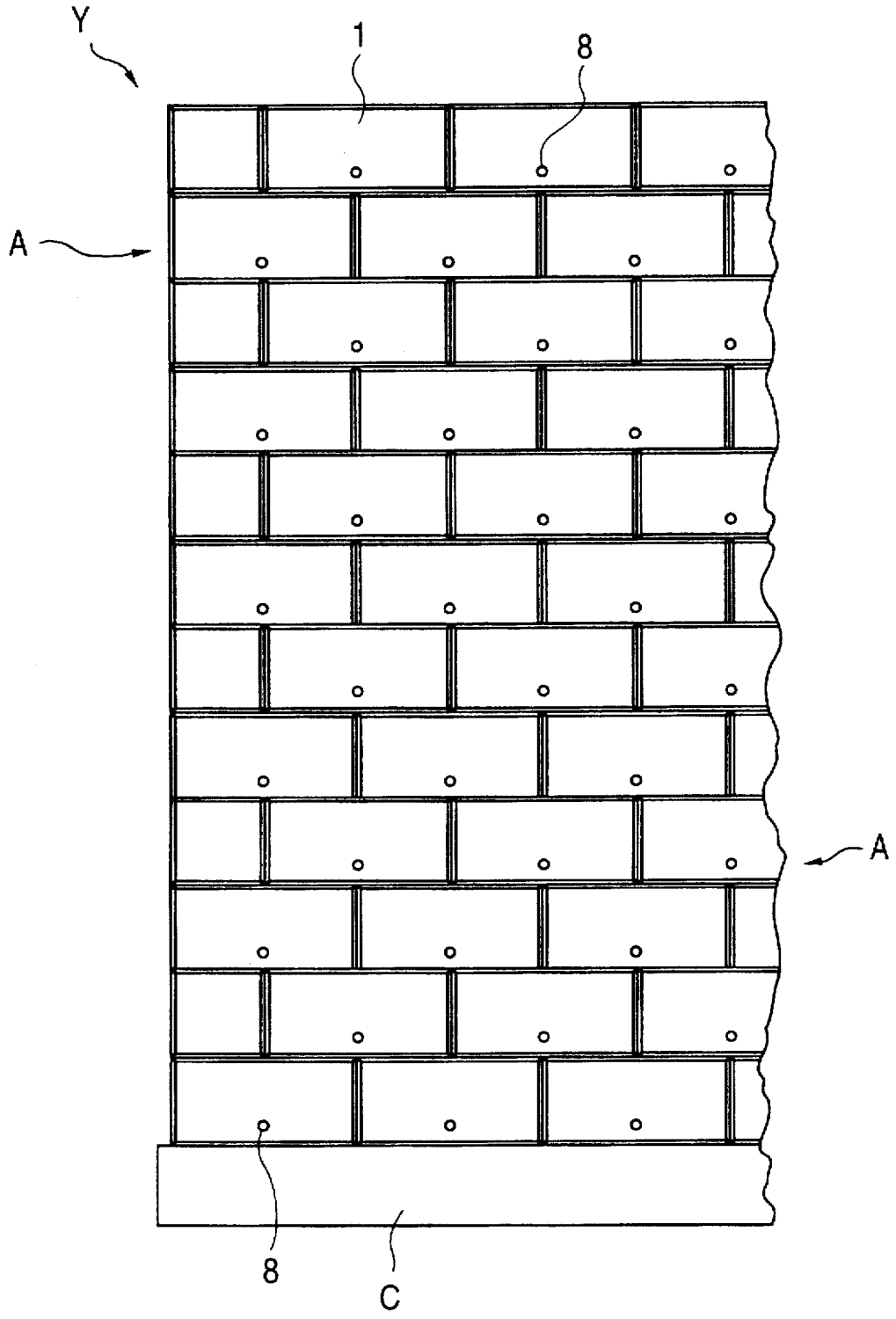
FIG. 2 is a front view showing a portion of the retaining wall in accordance with the first embodiment thereof.

As shown in FIGS. 1 and 2, reference symbol "A" denotes a block or blocks for a retaining wall of a leaning type in accordance with a first embodiment of the present invention. The word "block" or "blocks" as referred to in the following description is intended to mean such a block or blocks for the retaining wall of a leaning type. Reference symbol "Y" denotes a general term for a retaining wall of a leaning type in accordance with the present invention, which is constructed or built with the blocks therefor. Reference symbol "C" denotes a footing foundation on which the retaining wall of a leaning type is built or constructed with blocks therefor. Reference symbol "D" denotes ground prepared so as to become suitable or appropriate for the construction of the retaining wall, on which the retaining wall is to be constructed or built. Reference symbol "E" denotes a top concrete portion. Reference symbol "F" denotes a connecting steel string or bar for connecting a lower row of blocks to an upper row of blocks therefor. Reference symbol "G" denotes a filling and fixing material such as concrete or cement or mortar and reference symbol "U" denotes a backfilling material having a high water permeation, such as rubble stone, cobblestone or crusher crushed rock.

Figure 3:
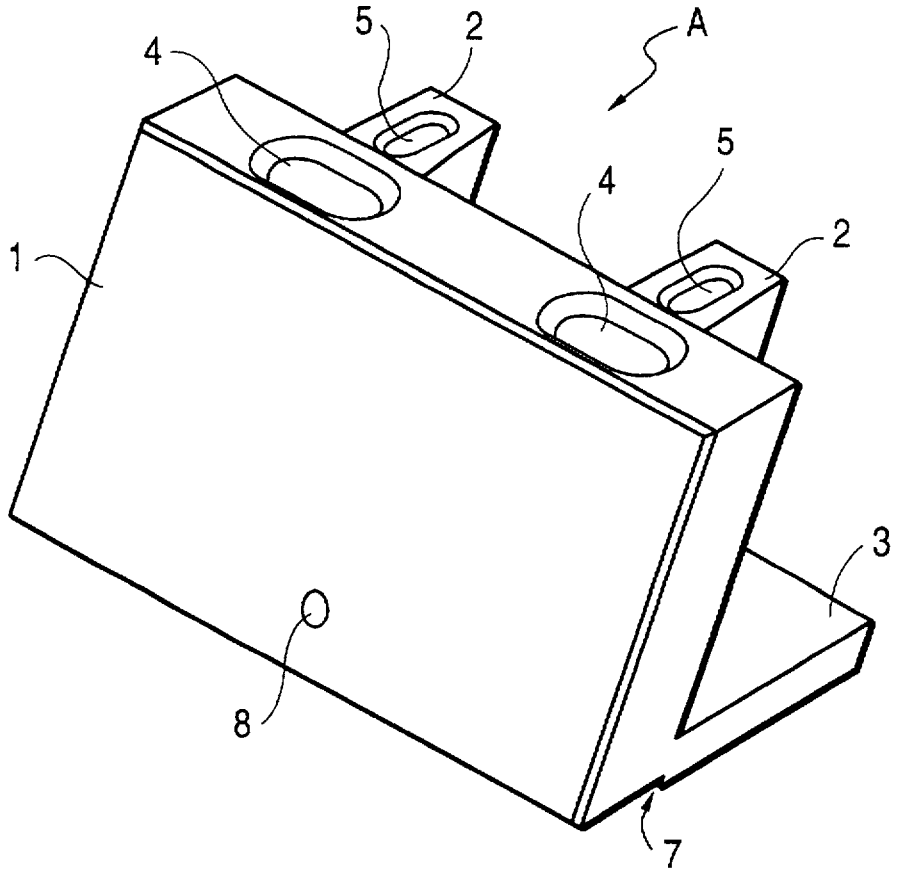
FIG. 3 is a perspective view showing a block for the retaining wall in accordance with the first embodiment thereof.
Figure 4:
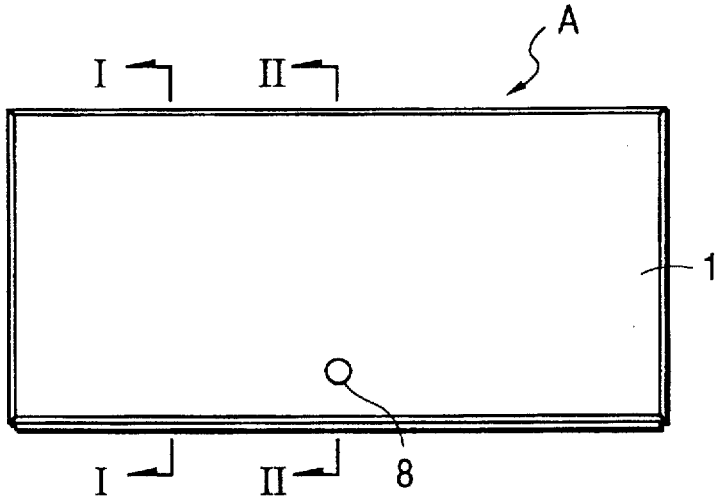
FIG. 4 is a front view showing the block therefor in accordance with the first embodiment thereof.
Figure 5:
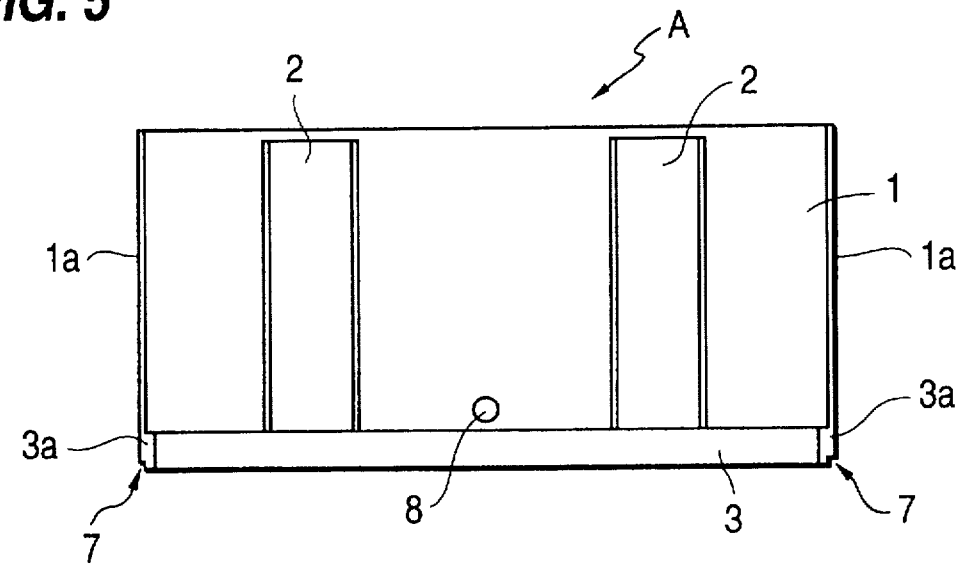
FIG. 5 is a rear view showing the block therefor in accordance with the first embodiment thereof.
Figure 6:
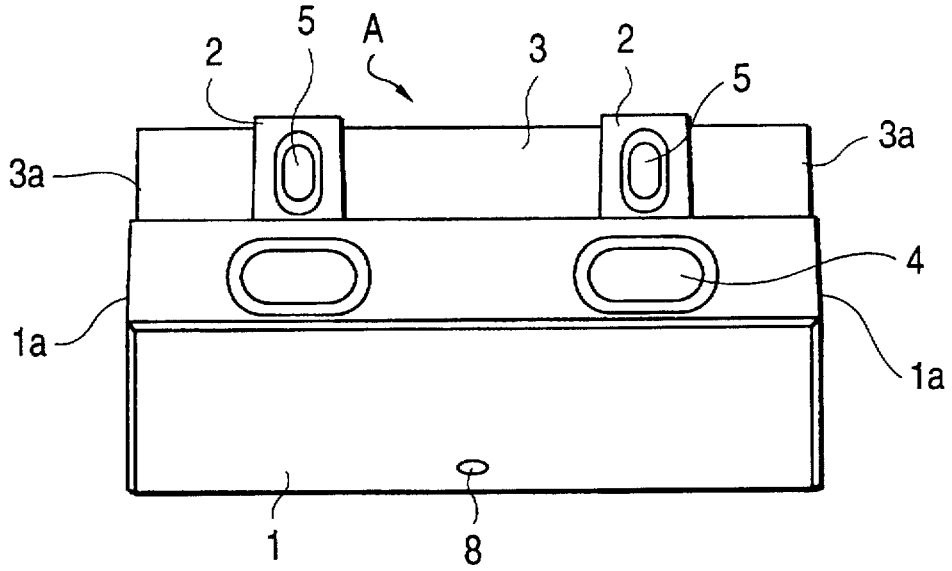
FIG. 6 is a top view showing the block therefor in accordance with the first embodiment thereof.
Figure 7:
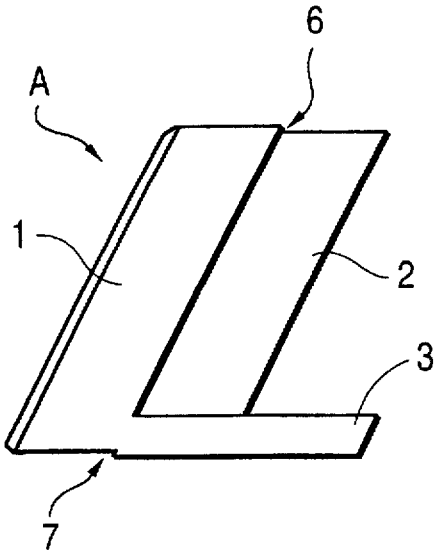
FIG. 7 is a side view showing a right-hand side of the block therefor in accordance with the first embodiment thereof.
Figure 8:
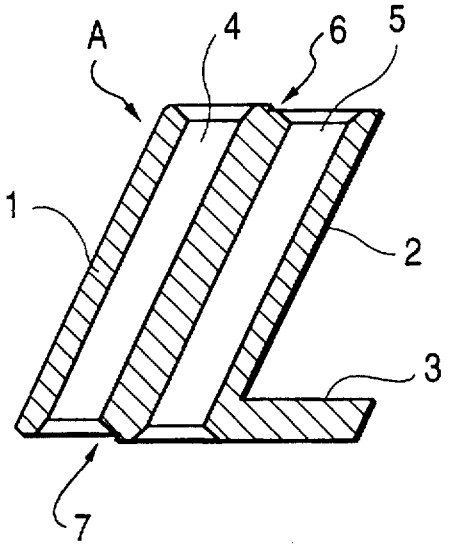
FIGS. 8 and 9 are each a side view in section showing the block therefor in accordance with the first embodiment thereof.
Figure 9:
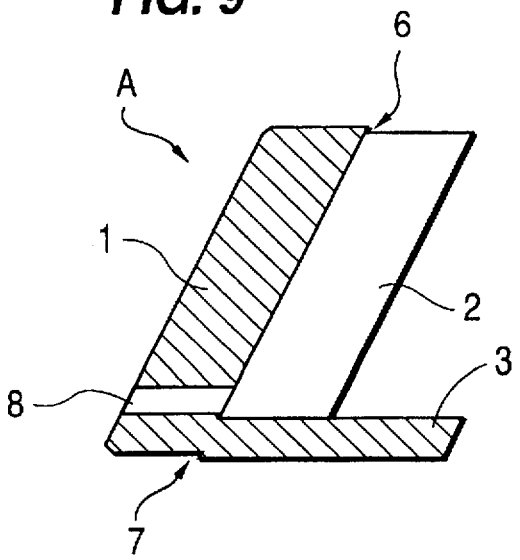

Now, a description will be made of a block for a retaining wall of a leaning type in accordance with a first embodiment of the present invention. FIGS. 3 through 9 are directed to the first embodiment of a block according to the present invention. FIG. 3 is a perspective view showing the block; FIG. 4 a front view showing the block; FIG. 5 a rear view showing the block; FIG. 6 a top view showing the block; FIG. 7 a side view showing the block; and FIGS. 8 and 9 are each a sectional view showing the block.

As shown in FIGS. 3 to 9, the block A comprises a front wall 1 of a rectangular-shaped plate, when looked from the front, a pair of a left-hand partition wall 2 and a right-hand partition wall 2, each of a sectionally rectangular-shaped column and being integrally formed therewith, and a bottom plate portion 3 formed integrally with the front wall 1.

As specifically shown in FIGS. 3, 4 and 6, the front wall 1 of the block A is provided with an opening, as referred to generally as 4, extending vertically through the entire height or length of the plate. The opening 4 may be of a generally rectangular shape in a horizontal section, with its front and rear sides extending along the width of the front wall 1 set longer than its left-hand and right-hand sides extending along the depth thereof and with its corners rounded off. It is preferred that the openings 4 are provided in the respective positions extending forward from the left-hand partition wall 2 and the right-hand partition wall 2. In or within the opening 4 is vertically disposed an iron bar or rod in order to enhance the physical strength of the retaining wall. The front wall 1 is also provided or formed at its lower portion with an opening 8 extending over the entire depth of the plate from the front to the rear, through which water is to be drained from the ground on which the retaining wall is constructed or built.

As specifically shown in FIGS. 3, 5 and 6, each of the left-hand partition wall 2 and the right-hand partition wall 2 is integrally provided or formed on a rear wall surface of the front wall 1, which extends vertically and projects in a rearward direction from the rear wall surface thereof. A bottom portion of each of the partition walls, as referred to generally as 2, is integrally formed or supported on an upper surface of the bottom plate portion 3. Each of the partition walls 2 is provided or formed with an opening, as referred to generally as 5, which extends vertically over the entire length or height of the column. The opening 5 is of a generally rectangular shape with its left-hand and right-hand sides set longer than its front and rear sides and with its corners rounded off. In and over the entire length of the opening 5 is vertically disposed an iron bar or rod in order to enhance the physical strength of the retaining wall.

As shown in FIGS. 7 to 9, when looked from the side, the block A is of a generally L-shaped form such that the front wall 1 leans backward at a predetermined angle of inclination with its top portion located in a backward position and its bottom portion located in a position ahead of its upper portion. The top and bottom surfaces of the front wall 1 are made horizontal and extend parallel to each other. It is to be noted as preferred to set a slope gradient of an embankment thereof so as to generally coincide with or to become approximately equal to a slope gradient of a slope surface of the ground D because it is easy to lay a row of blocks onto another row, or a lower row of blocks, thereby assisting simplify the construction of the retaining wall Y of the leaning type.

At the rear bottom portion is integrally formed the bottom plate portion 3 which is of a generally rectangular-shaped plate, when looked from the top. The bottom plate portion 3 extends and projects backward from the bottom rear wall portion of the front wall 1 and the bottom surface of the bottom plate portion 3 is disposed so as to extend generally straight and horizontally from the bottom surface of the front wall 1. As described hereinabove, at the boundary between the rear wall portion of the front wall 1 and the upper front side of the bottom plate portion 3 are integrally disposed and formed the partition walls 2. The block A has each of the partition walls 2 having the depth shorter than the depth of the bottom plate portion 3. In other words, the horizontal depth or length of a combination of the front wall 1 with each of the partition walls 2 is shorter than that of a combination of the front wall 1 with the bottom plate portion 3.

Further, a top surface of each of the left-hand partition wall 2 and the right-hand partition wall 2 is set to be lower in height than the top surface of the front wall 1. Thus, there is formed a top step portion 6 at the boundary between the rearmost edge of the top surface of the front wall 1 and the front edge of the top surface of the partition walls 2. In other words, the rearmost top edge of the front wall 1 is disposed in a position higher than the far front top edge of each of the partition walls 2. Likewise, there is formed a bottom step portion 7 at a bottom surface at the boundary between the rearmost bottom edge of the front wall 1 and the far front bottom edge of the bottom plate portion 3. When the upper block A is laid onto the lower block A, the top step portion 6 of the lower block A has the function to abut with the bottom step portion 7 of the upper block A. More specifically, the top rear wall portion of the front wall 1 structuring the top step portion 6 of the lower block A serves as a protective wall that can prevent the upper block A from sliding and falling down forward even when the force is applied forward from the rear to the blocks A. Likewise, the bottom step portion 7 of the lower block A is caused to abut with a top step portion 6 of another lower block A laid below the lower block A, thereby preventing the lower block A from sliding and falling down forward. In this case, the far front edge surface portion of the bottom plate portion 3 structuring the bottom step portion 7 of the upper block A and extending downward from the bottom surface of the front wall 1 is caused to abut with the top rear wall portion of the front wall 1 structuring the top step portion 6 of the lower block A, thereby preventing the upper block A from sliding and falling down forward. The retaining wall Y is disposed over its entire area in such a manner that an upper row of the blocks A is laid onto a lower row of the blocks A with the bottom step portions 7 of the upper blocks A disposed in abutment with or engagement with the top step portions 6 of the lower blocks A, thereby preventing the upper row of the blocks A from sliding forward even when force is applied forward from the rear to the blocks A.

If either or both of the top step portions 6 or/and the bottom step portion 7 would cause problems in constructing a retaining wall with blocks A so as to adapt particularly to a curved wall portion of a road or the like, a block A according to the present invention may be structured without one or both of the top step portion 6 and the bottom step portion 7.

Further, as shown in FIGS. 5 and 6, left-hand and right-hand side wall portions of the front wall 1, as referred to generally as 1*a*, may be disposed in such a manner that the width of the front wall 1 between the left-hand and right-hand side walls becomes gradually smaller from the front toward the rear. Likewise, left-hand and right-hand side portions of the bottom plate portion 3, as referred to generally as 3*a*, may be disposed in such a manner that the width of the bottom plate portion 3 becomes gradually smaller from the front toward the rear. Further, left-hand and right-hand side wall portions of each of the partition walls 2 may be disposed in such a manner that the width of the respective partition wall 2 between the left-hand and right-hand side walls becomes gradually smaller from the front toward the rear.

When the lower block A is laid onto the upper block A, the bottom surface of the bottom plate portion 3 of the upper block A is placed on the top surfaces of the partition walls 2 of the lower block A in such a manner that the openings 4 extending vertically through the front wall 1 of the upper block A communicate with the openings 4 extending vertically through the front wall 1 of the lower block A and that the openings 5 extending vertically through the partition walls 2 of the upper block A communicate with the openings 5 extending vertically through the partition walls 2 of the lower block A. Through and within the openings 4 and 5 are disposed iron bars or rods.

Now, a description will be made of the method for the construction of the retaining wall Y of the leaning type using the blocks A according to the present invention.

First, at a construction site such as a wall of a dike or a side wall of a road, on which the retaining wall Y is to be constructed and built, the earth is cut or shoveled away from the ground and the ground is levelled or is made even, in order to make the ground ready or appropriate for construction of the retaining wall Y.

At the foot portion of the ground or the construction site is constructed or built a footing foundation C on which in turn the retaining wall Y is to be constructed and built in a manner conventional and well known in the state of art. In the footing foundation C are provided a number of apertures necessary for insertion of iron bars or rods 10 which are to be inserted through and fixed in the openings 4 and 5 of the blocks A that in turn are to be laid onto the footing foundation C. The iron bars or rods are disposed extending and projecting upward from the upper face of the footing foundation C.

Onto an upper surface of the footing foundation C is laid a lowest row of blocks A so as to allow the upwardly extending iron bars or rods to be inserted through the corresponding openings 4 and 5 of the blocks A.

On the upper surface of the footing foundation C is provided and formed a step portion 9 that can adapt to and abut with or engage with the bottom step portion 7 of the blocks A laid in the lowest row on the footing foundation C in a secure manner. The arrangement of the step portion 9 of the footing foundation C with the bottom step portion 7 of the blocks A can prevent the lowest row of the blocks A from sliding forward even when an external force is applied forward from the rear.

A space S formed behind the rear walls of the blocks A and above the bottom plates 3 thereof is filled with the backfilling material which may, in many cases, include the earth that has been cut or shoveled away from the construction ground site. In this case, an appropriate number of leading plates (not shown) may be disposed so as to adapt to the corresponding number of the drain openings 8 of the blocks A, thereby leading water penetrating through the backfilling material to the drain openings 8 and enabling such water to be drained or withdrawn from the space S.

Another iron bars or rods F are disposed in a spaced relationship apart from and sideways with the iron bars or rods 10 disposed in the openings 4 and 5 of the blocks A from the top onto the corresponding openings 4 and 5 thereof. The iron bars or rods F are then connected to the iron bars or rods 10 with an iron steel wire.

The openings 4 and 5 in which the iron bars or rods 10 tied to the iron bars or rods F have been disposed extending upward is filled with the filling and solidifying material, thereby causing the material filled in the openings to solidify, while being allowed to stand for a while and fixing the lowest row of the blocks A to the footing foundation C in a secure manner.

Onto the lowest row of the blocks A is laid a second row of blocks A by inserting the iron bars or rods 10 tied to the iron bars or rods F projecting upward from the lowest row of the blocks A from the top into and the corresponding openings 4 and 5 of the blocks A in the second row and passing them therethrough. In this case, the top step portion 6 of each of the lowest row of the blocks A is caused to adapt to and but with the bottom step portion 7 of each of the second row of the blocks A. More specifically, the rear wall portion of the front wall 1 structuring the top step portion 6 of the corresponding block A in the lowest row and projecting upward from the top surface of the respective partition walls 2 is caused to abut with the front edge portion of the bottom step portion 7 of the corresponding block A in the second row and extending downward from the bottom surface of the front wall 1.

Further, a third row of blocks A is laid onto the second row of the blocks A in the same manner as the second row of the blocks A have been laid onto the lowest row of the blocks A. In this case, more specifically, the rear wall portion of the front wall 1 structuring the top step portion 6 of the corresponding block A in the second row and projecting upward from the top surface of the respective partition walls 2 is caused to abut with the front edge portion of the bottom step portion 7 of the corresponding block A in the third row and extending downward from the bottom surface of the front wall 1.

In other words, generally speaking, an upper row of blocks A is laid onto a lower row of blocks A by inserting iron bars or rods 10 projecting upward from the lower row of the blocks A from the top into the corresponding openings 4 and 5 of the upper row of the blocks A and passing them therethrough in substantially the same manner as described hereinabove. When the upper-row blocks A are to be laid onto the lower-row blocks A, it is preferred to place the upper-row blocks A on the lower-row blocks A in a staggered manner. In other words, one piece of the upper-row block A is superimposed bridging two adjacent pieces of the lower-row blocks A so as to place a half portion of the upper-row block A onto a right-hand half portion of the lower-row block A laid on the left-hand side and the other half portion of the upper-row block A onto a left-hand half portion of the lower-row block A laid on the right-hand side, as shown in FIG. 2. More specifically, one piece of the upper-row block A is laid onto two pieces of the lower-row blocks A in such a manner that the upper-row block A is superimposed on one of the two pieces of the lower-row blocks A by placing the left-hand partition wall 2 of the upper-row block A onto the right-hand partition wall 2 of the left-hand lower-row block A and the right-hand partition wall 2 of the upper-row block A onto the left-hand partition wall 2 of the right-hand lower-row block A and communicating the opening 5 of the left-hand partition wall 2 of the upper-row block A and the opening 5 of the right-hand partition wall 2 of the upper-row block A with the opening 5 of the corresponding left-hand lower-row block A.

As each of the far left-hand and right-hand sides of the retaining wall Y becomes staggered when the retaining wall Y is constructed and built in the manner as described hereinabove, each side of the retaining wall Y may be arranged properly or in an upright order, if so needed, by using a block having a half size of the block A and one partition wall 2 and having no drain opening. More specifically, when one piece of the upper-row block A is laid on two pieces of the lower-row blocks A, each of the far left-hand and right-hand sides of the upper row of the blocks A is shorter by a half portion of one piece of the block A than the adjacent lower row of the blocks and than the row laid above the corresponding upper row of the blocks A. At each of the sides of the upper row of the blocks A is disposed the block having a half size, thereby making the far left-hand and right-hand sides of the retaining wall Y even in a vertical direction.

After an uppermost row of blocks A has been laid on a penultimate row of blocks A and the space S behind the rear walls of the front walls 1 of the blocks A in the uppermost row and above the bottom plate portions 3 thereof in the manner as described hereinabove, a top concrete portion E is integrally laid thereonto in order to fix the retaining wall Y in a secure manner to the side wall of the ground.

The retaining wall Y constructed and built integrally with the footing foundation C in the manner as described hereinabove can constitute a rigid structure.

Then, a description will be made of a second embodiment of a retaining wall Y according to the present invention with reference to FIGS. 10 to 14. Same parts structuring the elements of the blocks A and the retaining wall Y are provided with the same reference symbols and numerals and a detailed description of the same elements is omitted for brevity of explanation.

Figure 12:
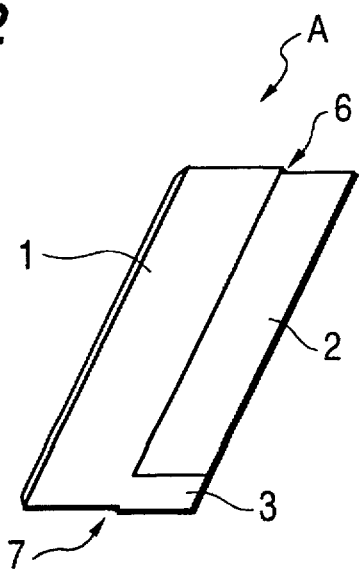
FIG. 12 is a side view showing a right-hand side of the block therefor in accordance with the first embodiment thereof.
Figure 13:
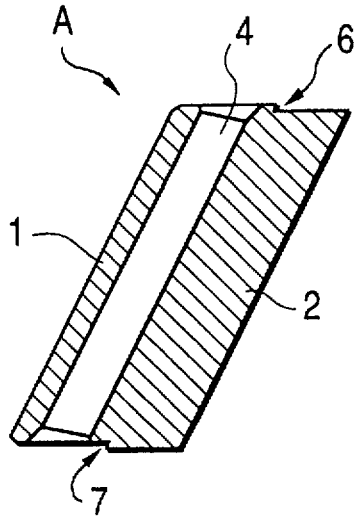
FIGS. 13 and 14 are each a side view in section showing the block therefor in accordance with the first embodiment thereof.
Figure 14:
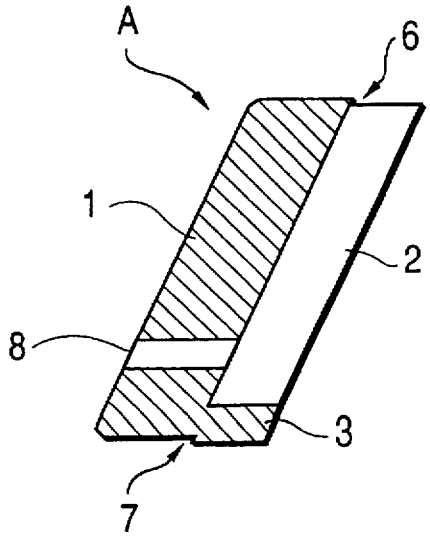

As shown in FIGS. 10 to 14, for the second embodiment of the retaining wall Y according to the present invention, there are employed blocks A having substantially the same structure except two left-hand and right-hand partition walls 2 and 2, respectively, having no opening therein for insertion of iron bars or rods 10. As shown in FIGS. 12 to 14, the block A has the partition walls 2 having the depth as long as the depth of the bottom plate portion 3. In other words, the horizontal depth or length of a combination of the front wall 1 with the partition wall 2 is as long as the horizontal depth or length of a combination of the front wall 1 with the bottom plate portion 3. Further, the both sides of the front wall 1 and the bottom plate portion 3 are arranged at an angle substantially right to the front surface of the front wall 1. In other words, the bottom surface of the combination of the front wall 1 with the bottom plate portion 3 is generally square in shape.

Figure 10:
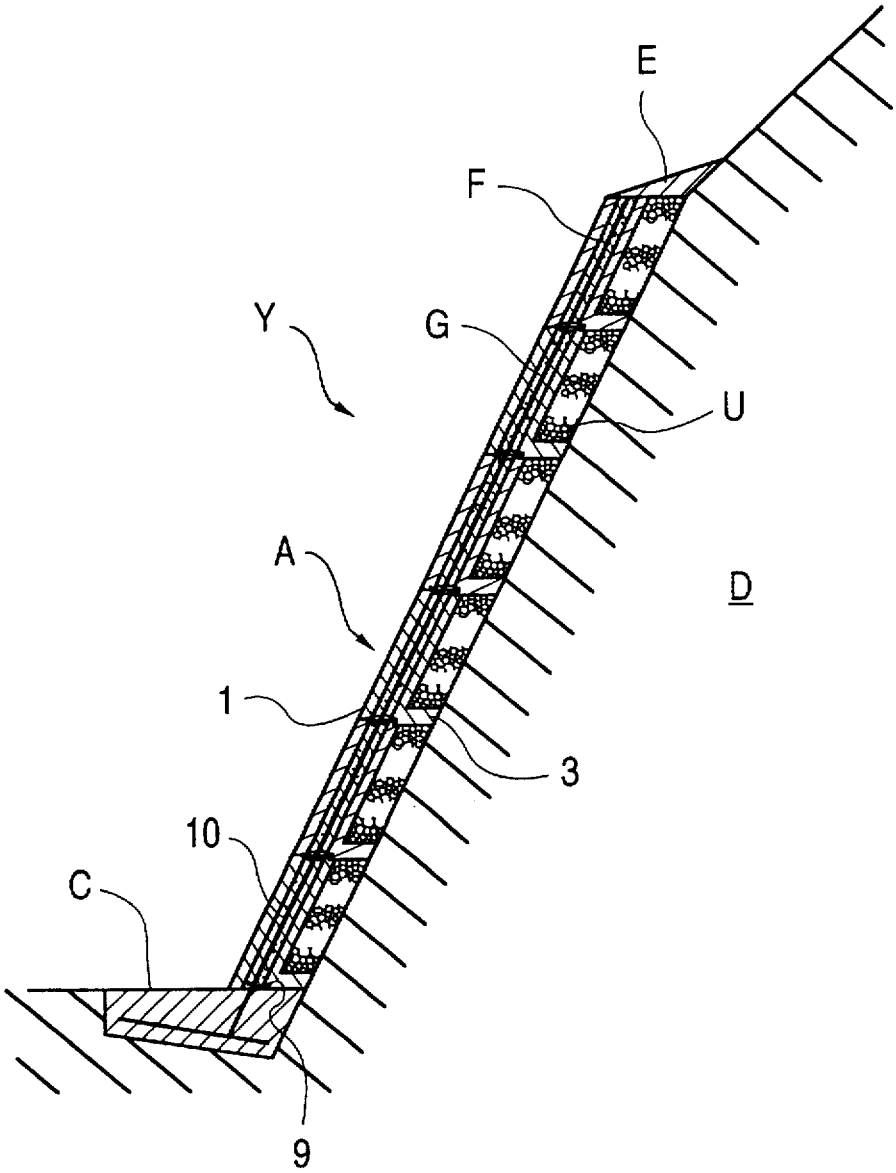
FIG. 10 is a side view in section showing a retaining wall of a leaning type constructed with blocks in accordance with a section embodiment of the present invention.
Figure 11:
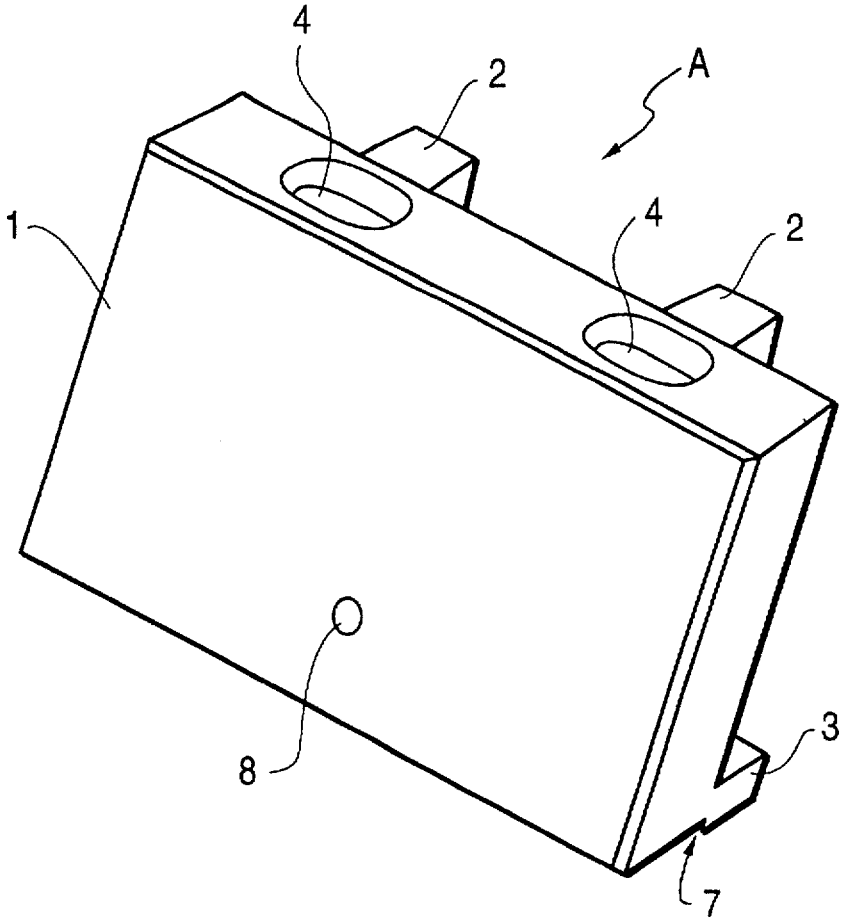
FIG. 11 is a perspective view showing a block for the retaining wall in accordance with the second embodiment thereof.

As shown in FIG. 10, the retaining wall 1 according to the second embodiment of the present invention can be constructed and built in substantially the same manner as the retaining wall Y according to the first embodiment of the present invention in the manner as described hereinabove.

Figure 15:
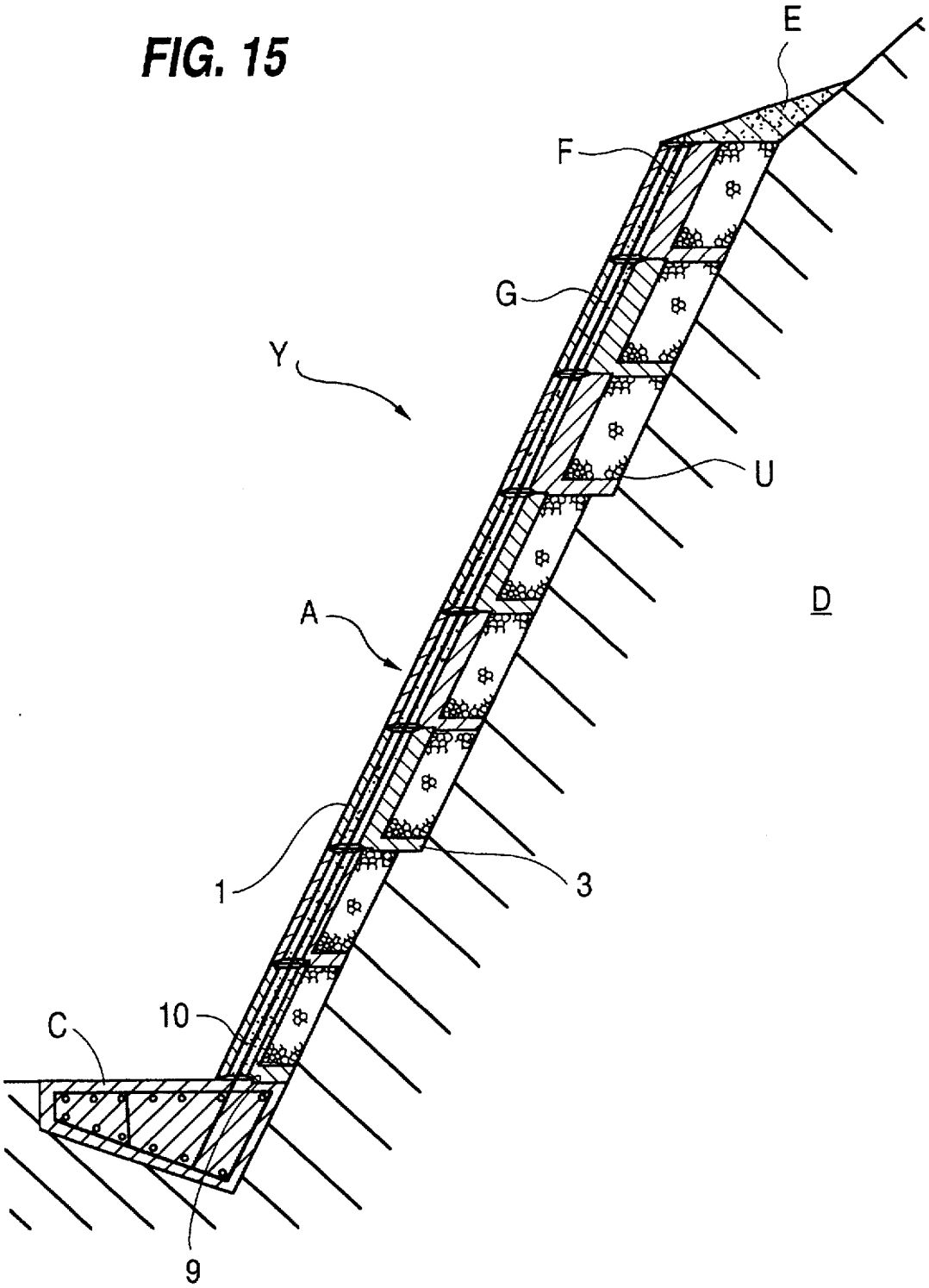
FIG. 15 is a side view in section showing a retaining wall of a leaning type constructed with blocks in accordance with a third embodiment of the present invention.

FIG. 15 is directed to a retaining wall Y according to a third embodiment of the present invention. Although this embodiment is described as a variant of the retaining wall Y according to the second embodiment of the present invention as described hereinabove, the description of the retaining wall Y according to the first embodiment of the present invention can also be applied to this embodiment.

As shown in FIG. 15, the retaining wall Y is constructed and built with blocks A which have different sizes particularly in depth. In other words, there are employed, for example, three different types of blocks A; one type of blocks A having the total depth or horizontal length of a combination of the front wall 1 with each of the partition walls 2 and with the bottom plate portion 3 shorter than those of the other two types of blocks A; a second type of blocks A having the total depth or horizontal length of a combination of the front wall 1 with each of the partition walls 2 and with the bottom plate portion 3 longer than that of the first type thereof and shorter than those of a third type of blocks A; and the third type of the blocks A having the total depth or horizontal length of a combination of the front wall 1 with each of the partition walls 2 and with the bottom plate portion 3 longer than those of the other two types of blocks A.

As shown in FIG. 15, in the third embodiment, the retaining wall Y has the blocks A with a longer depth laid at upper positions. More specifically, the retaining wall Y is shown to be constructed and built with the blocks A having three different sizes of depth. In lower two rows, the blocks A of the first type having the shortest depth are disposed. Then, the blocks A of the second type having the middle depth are laid in three rows on the second row of the blocks A of the first type. Onto the uppermost row of the blocks A of the second type are laid the blocks A of the third type having the longest depth in three rows.

By disposing the blocks A having the longer depth or a larger sectional dimension above lower rows of the blocks A having the shorter depth or a smaller sectional dimension, a resisting moment acting toward the rear, i.e. upon the ground on which the retaining wall Y has been constructed and built, can be made larger, thereby making the retaining wall Y more unlikely to slide forward and to be fallen down forward and making a fall-down safety factor of the retaining wall Y higher.

It is to be noted as a matter of course that in the third embodiment the number of the rows of the blocks A and the number of the different types of the blocks A are not limited to those as described hereinabove and they may vary properly so as to adapt to different types of construction sites.

Figure 16:
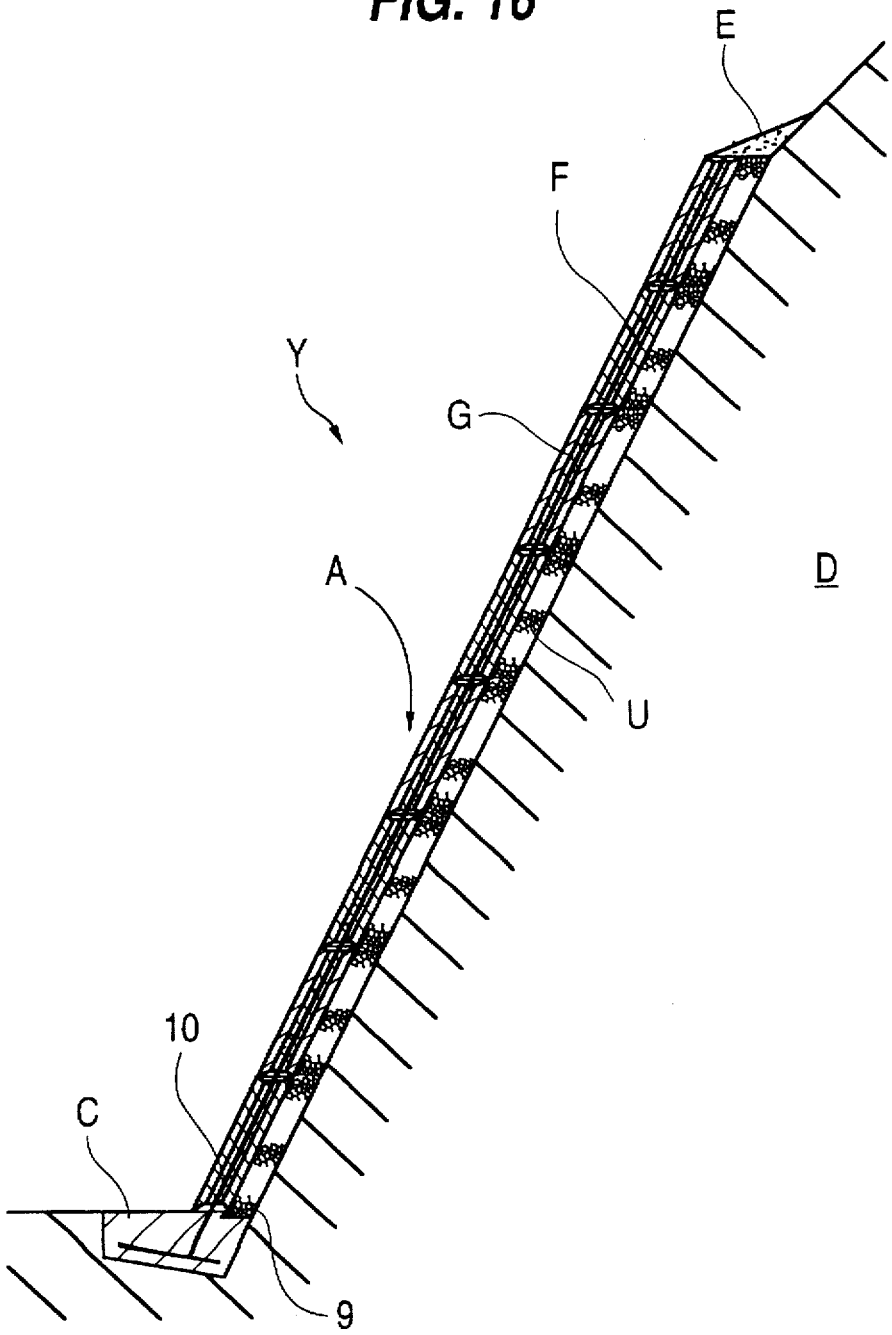
FIG. 16 is a side view in section showing a retaining wall of a leaning type constructed with blocks in accordance with a fourth embodiment of the present invention.
Figure 17:
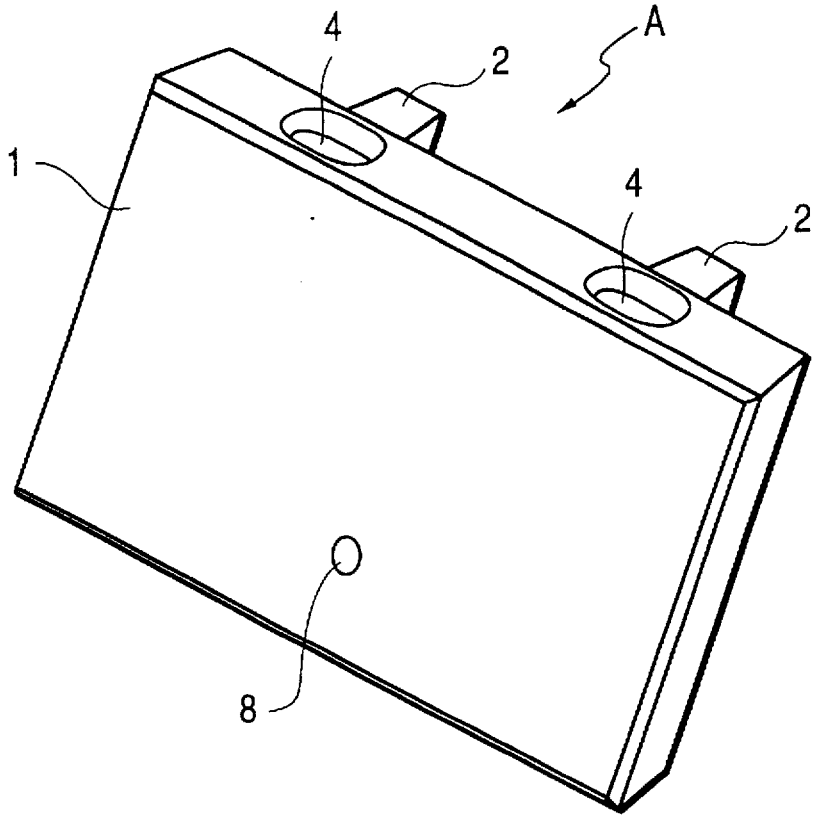
FIG. 17 is a perspective view showing a block for the retaining wall in accordance with the fourth embodiment thereof.
Figure 18:
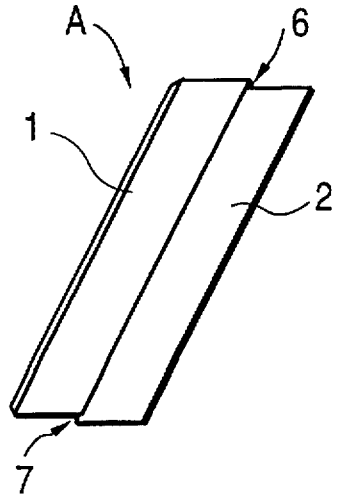
FIG. 18 is a side vie showing a right-hand side of the block therefor in accordance with the fourth embodiment thereof.
Figure 19:
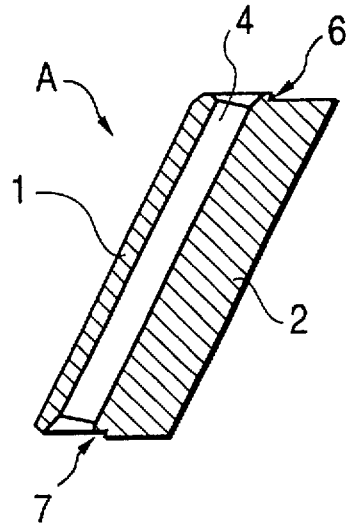
FIGS. 19 and 20 are each a side view in section showing the block therefor in accordance with the fourth embodiment thereof.
Figure 20:
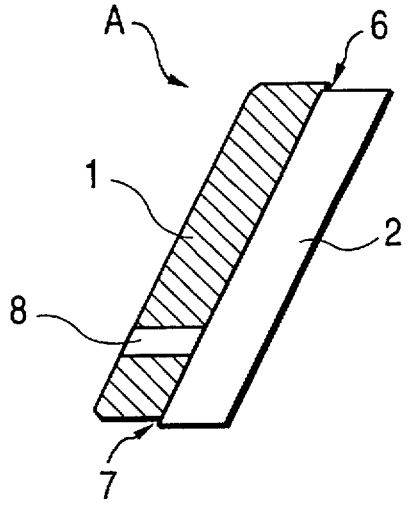

FIGS. 16 to 20 are directed to a fourth embodiment of a retaining wall Y in accordance with the present invention. As shown in FIGS. 17 to 20, blocks A appropriate for the construction of the retaining wall Y according to the fourth embodiment of the present invention are shown to have the partition walls 2 integrally formed with the rear wall of the front wall 1 without any bottom plate. In this embodiment, the partition walls 2 are provided with no openings through which iron bars or rods are otherwise to be inserted. As shown in FIG. 16, the blocks A can be constructed and built to form the retaining wall Y according to the fourth embodiment of the present invention in substantially the same manner as the retaining wall Y in the third embodiment of the present invention.

FIGS. 21 to 24 are directed to a retaining wall Y in accordance with a fifth embodiment of the present invention. Blocks A to be appropriately employed for the retaining wall Y according to the fifth embodiment of the present invention are structured in substantially the same manner as the blocks A to be appropriately employed for the retaining wall Y according to the second embodiment of the present invention, with the exception that the bottom plate portion 3 is arranged at an angle substantially right to the front wall 1 and that no step portions are formed at the boundary between the rear wall portion of the front wall 1 and the uppermost front edge of each of the partition walls 2.

Figure 21:
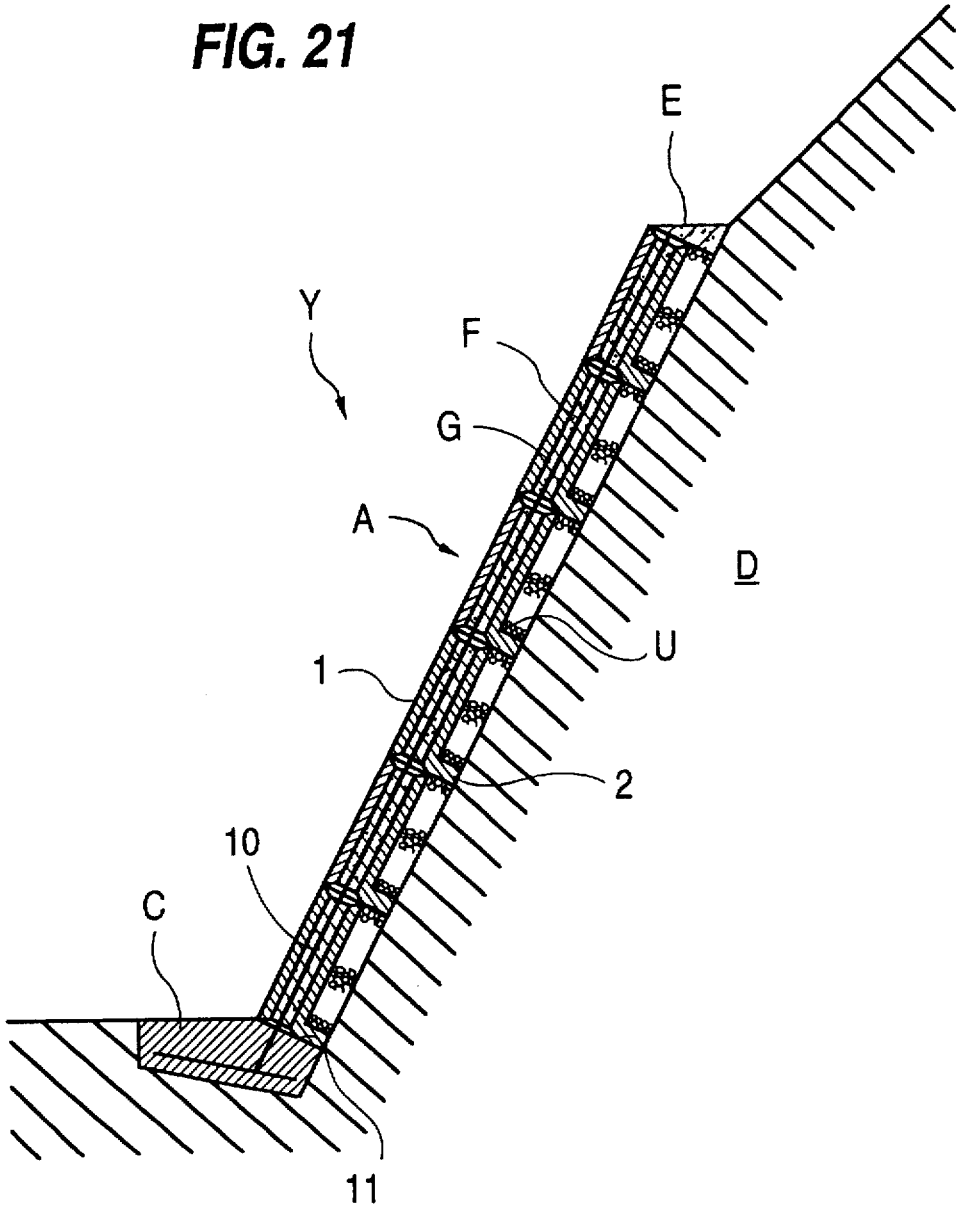
FIG. 21 is a side view in section showing a retaining wall of a leaning type constructed with blocks in accordance with a fifth embodiment of the present invention.
Figure 22:
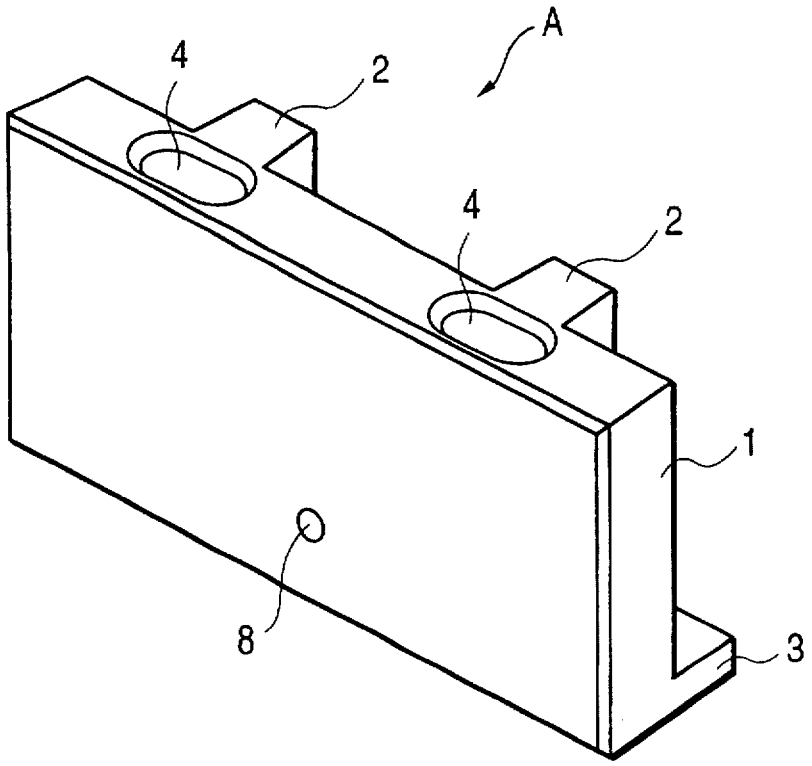
FIG. 22 is a perspective view showing a block for the retaining wall in accordance with the fifth embodiment thereof.
Figure 23:
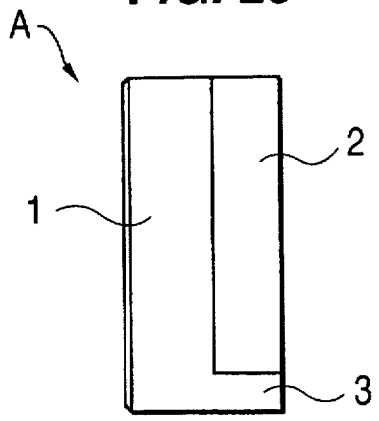
FIG. 23 is a side view showing a right-hand side of the block therefor in accordance with the fifth embodiment thereof.
Figure 24:
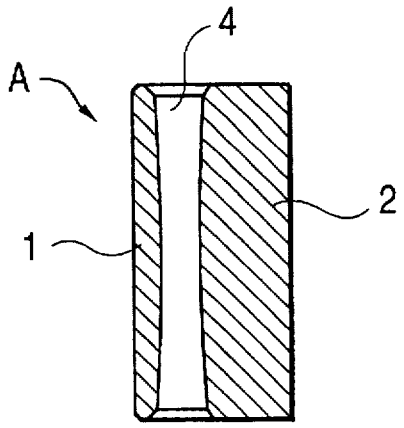
FIGS. 24 and 25 are each a side view in section showing the block therefor in accordance with the fifth embodiment thereof.
Figure 25:
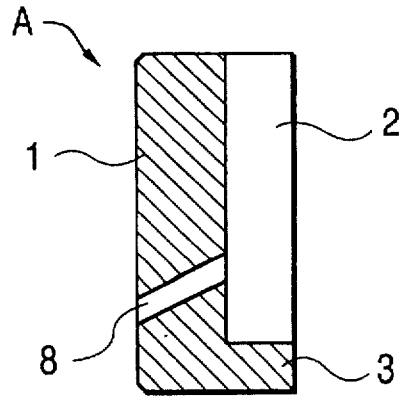

In order to construct or build the fifth embodiment of the retaining wall Y with the blocks A having the structure as described hereinabove, a footing foundation C is constructed and built in such a manner that, as shown in FIG. 21, its upper rear surface 11 onto which the retaining wall Y is to be constructed and built is disposed at an angle of inclination appropriate for the construction of the retaining wall Y. In other words, in order to allow the retaining wall Y to be constructed and built at an angle of inclination appropriate for or substantially agreeable with an angle of inclination of the ground surface, the blocks A are required to be laid onto each other in postures leaning backward at an appropriate angle of inclination. At this end, the inclined rear surface of the footing foundation C is arranged at an angle of inclination in such a manner that it can be adapted to the front surfaces of the front walls 1 of the blocks A laid thereonto at substantially right angle of inclination, when looked from the side. In other words, the angle of inclination of the front wall 1 of the lowest row of the blocks A located or laid onto the inclined rear surface portion of the footing foundation C is set to be approximately identical to the slope gradient of the wall surface of the ground D.

Onto the lowest row of the blocks A are laid a necessary number of rows of the blocks A, as shown in FIG. 21, in the manner as described hereinabove to form the retaining wall Y in the fifth embodiment of the present invention.

Now, a description will be made of a retaining wall Y in a sixth embodiment of the present invention with reference to FIGS. 27 to 30. For the retaining wall Y in accordance with the sixth embodiment of the present invention, blocks A to be appropriately employed therefor are structured in substantially the same manner as the blocks A to be appropriately employed for the retaining wall Y according to the fifth embodiment of the present invention, with the exception that the front bottom edge of the front wall section of the front wall 1 is substantially right to the bottom surface of the front wall 1, that no step portions are formed at the boundary between the rear wall portion of the front wall 1 and the uppermost front edge of each of the partition walls 2, and that no bottom plate portion is provided yet the partition walls 2 are integral to the rear walls of the front wall 1 over its entire vertical length from the top to the bottom.

Figure 26:
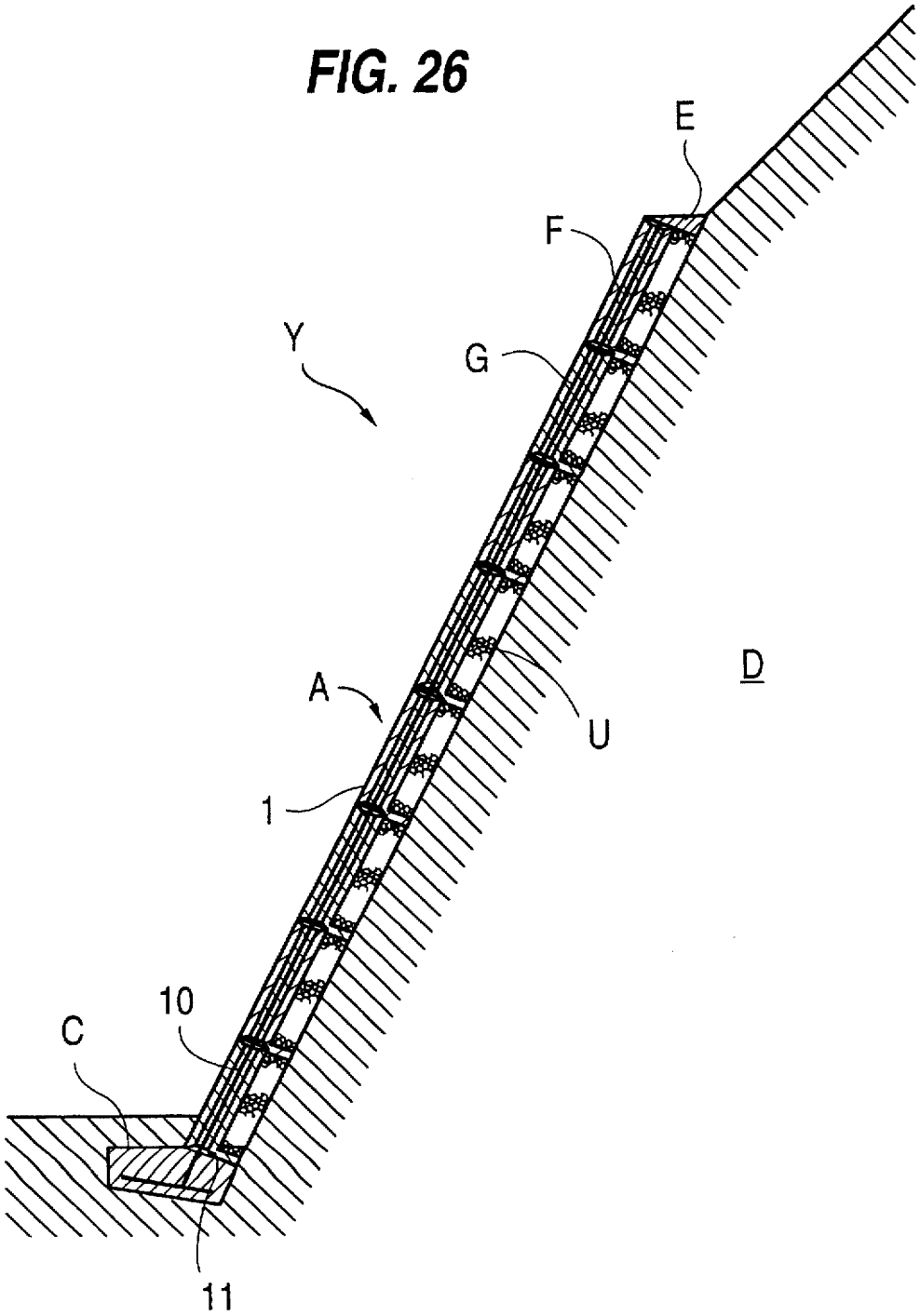
FIG. 26 is a side view in section showing a retaining wall of a leaning type constructed with blocks in accordance with a sixth embodiment of the present invention.
Figure 27:
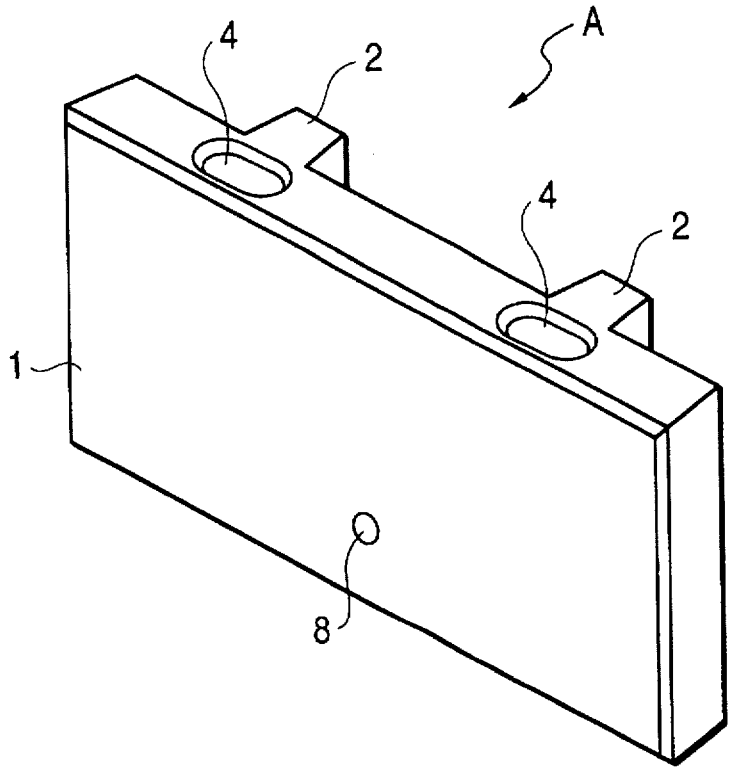
FIG. 27 is a perspective view showing a block for the retaining wall in accordance with the sixth embodiment thereof.
Figure 28:
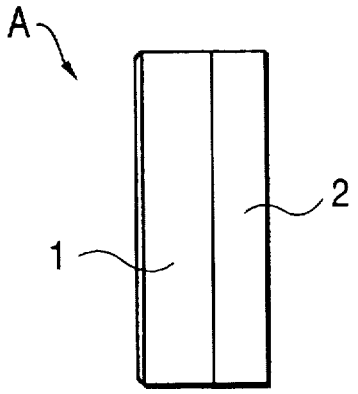
FIG. 28 is a side view showing a right-hand side of the block therefor in accordance with the sixth embodiment thereof.
Figure 29:
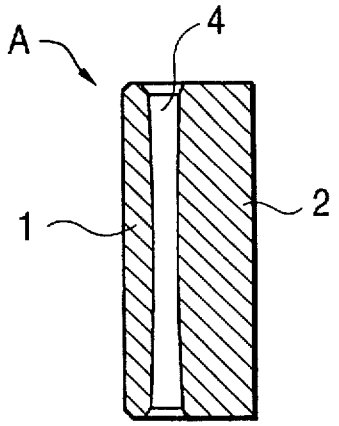
FIGS. 29 and 30 are each a side view in section showing the block therefor in accordance with the fifth embodiment thereof.
Figure 30:
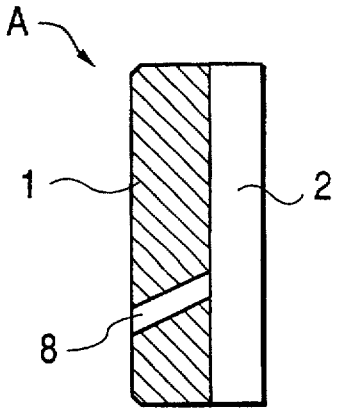

As shown in FIG. 26, the retaining wall Y in the sixth embodiment of the present invention can be constructed and built in substantially the same manner as described hereinabove about the retaining wall Y in the fifth embodiment of the present invention.

For the retaining walls Y in the first to sixth embodiments of the present invention, it is noted that iron bars or rods may be inserted and disposed through and within the openings formed in the front wall 1 as well as the partition walls 2 and the bottom plate portion 3 or in the front wall 1 to form a concrete block reinforced with an iron bar or rod. Further, the retaining walls Y may be disposed without any iron bar or rod to thereby form a concrete block without reinforcement with any reinforcing iron bar or rod. In addition, a material such as a synthetic resin other than concrete may also be employed.

Figure 31:
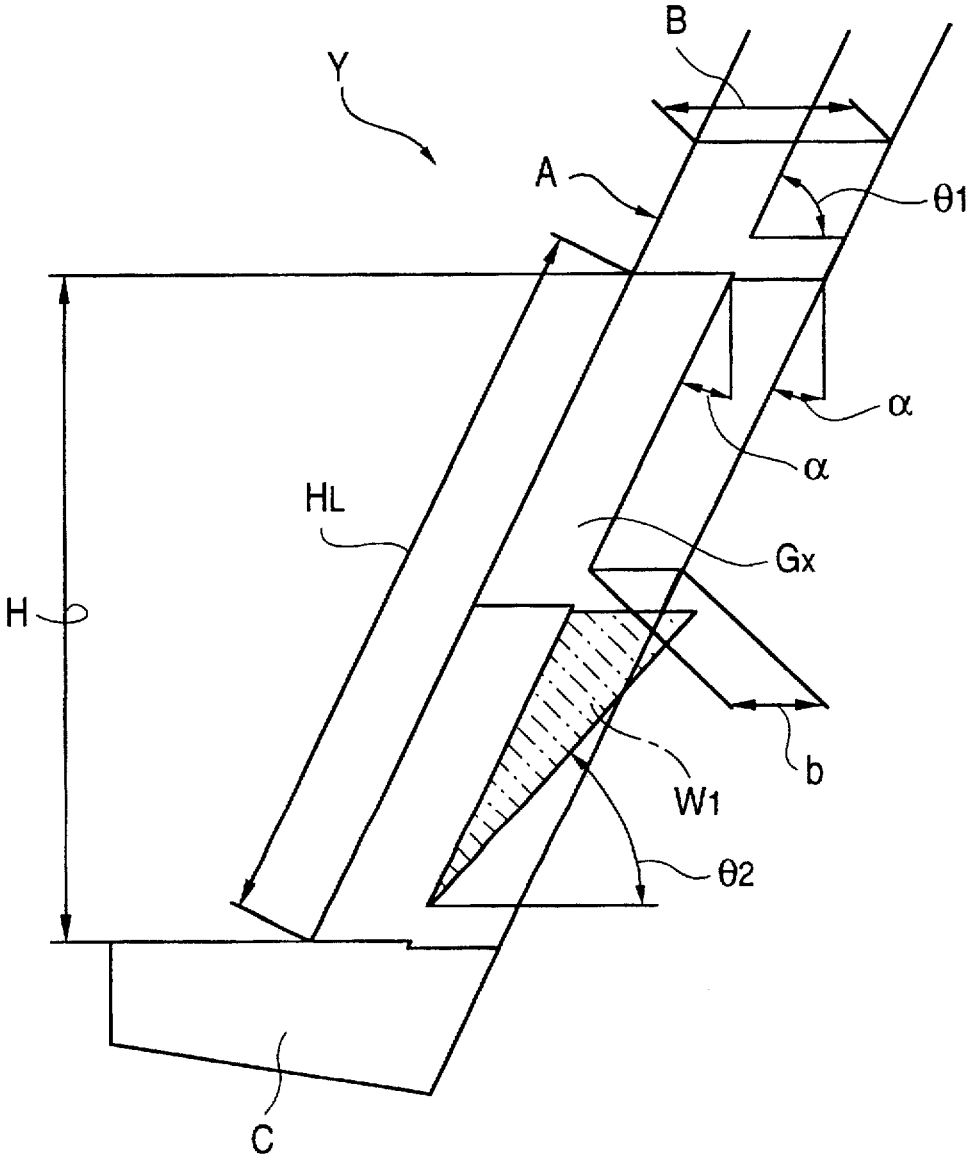
FIG. 31 is an explanatory side view showing the retaining wall of the leaning type in accordance with the second embodiment thereof.

The resisting moment applicable to the retaining wall Y in the second embodiment of the present invention will be calculated in a following manner with reference to FIG. 31.

The resisting moment can be calculated in a series of equations as will be described hereinafter.

First, the weight of the backfilling material in the amount per a height of one meter, as referred to by reference symbol "$\omega_1$" and as represented in tons per cubic meter, which applies a ground pressure to the block, will be calculated by equation (1) as follows:

Equation (1):

$$\omega_1 = h_0^2 \times r(\cot\theta_2 + \tan\alpha)/2 \quad (1)$$

wherein reference symbol "$h_0$" denotes a perpendicular height of the front wall 1 from the top surface of the bottom plate portion 3 to the top surface of the front wall 1 of the block, as represented in meter;

reference symbol "r" denotes a unit weight of the backfilling material, as represented in tons per cubic meter;

reference symbol "$\theta_2$" denotes an angle of inclination of a sliding surface with respect to its horizontal plane, in which the sectional area of the backfilling material is indicated as a right triangle when reference symbol $h_0$ is equal to or larger than $b \times \tan\theta_1$ (where reference symbol "b" denotes a width of the bottom plate portion 3 of the block) and it is indicated as a truncate when the reference symbol $h_0$ is smaller than $b \times \tan\theta_2$;

and reference symbol "α" denotes an angle of inclination of the rear wall of the block and the rear wall of the front wall 1 with respect to the perpendicular plane from the rear wall thereof, provided that this reference symbol is indicated as "−α" in the formula calculating the earth pressure.

Then, the angle of inclination of a sliding surface with respect to its horizontal plane, as referred to by reference symbol "$\theta_2$", is calculated by equation (2) as follows;

Equation (2):

$$\cot\theta_2 = -\tan(\theta + \delta + \alpha) + \frac{1}{\cos(\phi + \delta + \alpha)} \sqrt{\frac{\cos(\delta + \alpha) \times \sin(\phi + \delta)}{\cos\alpha \times \sin\phi}}$$

wherein reference symbol "δ" denotes an angle of friction of the rear wall surface of the front wall 1 with respect to the backfilling material, as indicated by $\frac{2}{3} \times \phi$; and reference symbol "φ" denotes an angle of friction of the backfilling material with the earth of the ground behind the backfilling material.

Further, the weight of the backfilling material in the amount corresponding to the height H, which applied an earth pressure to the block, as referred to by reference symbol "$\omega_2$" and as represented in tons per cubic meter, is calculated by equation (3) as follows:

Equation (3):

$$\omega_2 = H \times \omega_1 \quad (3)$$

wherein reference symbol "H" denotes a perpendicular height of the front wall 1 thereof from its foot to a position as high as or corresponding to the predetermined position of the front wall 1 of the block, as represented in meter, provided that the perpendicular height "H" is calculated by $H = H_L \times \cos\alpha$ (wherein $H_L$ is the length of the slope of the front wall 1, as represented in meter.

Then, the total earth pressure of the backfilling material acting upon the rear wall side of the retaining wall, as represented in tons per cubic meter, as referred to by reference symbol "Pa1", is calculated by equation (4) as follows:

Equation (4):

$$Pa1 = \omega_2 \times \sin(\theta_2 - \phi)/\cos(\theta_2 = \phi - \delta - \alpha) \quad (4)$$

Thereafter, the fall-down moment to be applied by the total earth pressure of the backfilling material, Pa1, as referred to by reference symbol "Mo1" and as represented in tons by meter per meter, is then calculated by equation (5) as follows:

Equation (5):

$$Mo1 \times Pa1 \times H/2 \quad (5)$$

Thus, the fall-down moment as referred to as reference symbol "Mr" can be calculated by equation (6) as follows:

Equation (6):

$$Mr = H \times W \times (H/2 \times \tan\alpha + Gx) \times b^2/2 \times \tan\theta 1 \times r \times (H/2 \times \tan\alpha + XD) \quad (6)$$

wherein reference symbol "W" denotes the weight of the block per cubic meter, as represented in tons;

reference symbol "Gx" denotes the distance from the front wall surface to the gravity, as represented in meter;

reference symbol "r" denotes the unit weight of the backfilling material; and reference symbol "X" denotes a length from the front wall surface of the front wall 1 to the gravity of the backfilling material filled in the space S, as represented in meter.

The fall-down moment "Mo1" and the resisting moment "Mr" give a fall-down safety factor as referred to by reference symbol "FS" which in turn is calculated by equation (7) as follows:

$$FS=Mr/Mo1 \quad (7)$$

Therefore, for example, when the parameters as referred to hereinabove are set in a manner as will be described hereinafter, the fall-down safety factor FS can be calculated in a series of equations as will be described hereinafter.

For example, by inserting the angle of friction of the rear wall surface of the front wall 1 with respect to the backfilling material, as referred to as "θ", as 35°, and the angle of friction of the backfilling material with the earth of the ground behind the backfilling material, as referred to as "δ", as 23.33°, and the angle of inclination of the rear wall of the block and the rear wall of the front wall 1 with respect to the perpendicular plane from the rear wall thereof, as referred to as "α", as −26.565°, into the equation (2) above, cot $\theta_2$ can be obtained by equation (2') as follows:

Equation (2'):

$$\cot\theta_2 = -\tan(35° + 23.33° - 26.565°) + \frac{1}{\cos(35° + 23.33° - 26.565°)} \times \sqrt{\frac{\cos(23.33° - 26.565°) \times \sin(35° + 23.33°)}{\cos(-26.565°) \times \sin 35°}}$$

By calculating the equation (2') above, cot $\theta_2$ is obtained as follows:

$$\cot\theta 2 = \cot 48.186°$$

Further, by setting the perpendicular height of the front wall 1 from the top surface of the bottom plate portion 3 to the top surface of the front wall 1 of the block, as referred to as "$h_0$", as 0.88 meter and the unit weight of the backfilling material, as referred to as "r", as 2.0 tons per $m^3$ and inserting these values into the equation (1) above, the weight of the backfilling material, as referred to as "$\omega_1$", can be calculated by equation (1') as follows:

Equation (1'):

$$\omega_1 = 0.88° \times 2.0 \times (\cot 48.186° \times -\tan 26.565°)/2 = 0.306 \text{ tons per meter}$$

Thus the weight of the backfilling material in the amount corresponding to the height H, as referred to as "$\omega_2$" can be obtained by equation (3'), for example, by inserting the weight as referred to as "$\omega_1$" obtained immediately hereinabove and the perpendicular height of the front wall 1 thereof from its foot to a position as high as or corresponding to the predetermined position of the front wall 1 of the block, as referred to as "H", set as 6.0 meters, into the equation (3) above.

$$\omega_2 = H \times \omega_1 = 6.0 \times 0.306 = 1.84 \text{ tons per meter} \quad (3')$$

Therefore, the total earth pressure of the backfilling material acting upon the rear wall aids of the retaining wall, as referred to by reference symbol "Pa1", can be calculated by equation (4') by inserting the corresponding parameters into the equation (4) as follows:

$$\begin{aligned} Pa1 &= \omega_2 \times \sin(\theta_2 - \alpha)/\cos(\theta_2 - \phi - \delta - \alpha) \\ &= 1.84 \times \sin(48.186° - 35°)/ \\ &\quad \cos(48.186° - 35° - 23.33° + 26.565°) \\ &= 0.438 \text{ ton per meter.} \end{aligned}$$

Therefore, the fall-down moment to be applied by the total earth pressure of the backfilling material, Mo1, is then calculated by equation (5') by inserting the corresponding parameters into the equation (5) above:

$$Mo1 = Pa1 \times H/2 = 0.438 \times 6.0/2 = 1.31 \text{ ton m/m} \quad (5')$$

Furthermore, when the weight per cubic meter of the block, "W", is set as 0.788 ton per cubic meter, the length from the front wall surface of the front wall 1 to the gravity of the front wall 1 of the block, "Gx", is set as 0.172 meter, the width of the bottom plate portion 3, "b", is set as 0.24 meter, and the length from the front wall surface of the front wall 1 to the gravity of the backfilling material in the space S, "X", is set as 0.42 meter, the resisting moment, "Mr", is calculated by equation (6') as follows:

$$\begin{aligned} Mr &= H \times W \times (H/2 \times \tan\alpha + Gx) + b^{2/2}\, x \\ &\quad \tan\theta 1 \times r \times (H/2 \times \tan\alpha + X) \\ &= 6.0 \times 0.788 \times (6.0/2 \times \tan 26.565° + 0.172) \times \\ &\quad 0.24^2 \times \tan 63.435° \times 2.0 \times (6.0/2 \times \tan 26.565° + 0.42) \\ &= 8.35 \text{ ton} \cdot \text{m/m} \end{aligned}$$

Accordingly, a fall-down safety factor "Fs" can be calculated by equation (7') by inserting the fall-down moment "Mo1" and the resisting moment "Mr", as obtained hereinabove, into the equation (7) as follows:

$$Fs = Mr/Mo1 = 8.35/1.31 = 6.4 \quad (7')$$

As is apparent from this result, the fall-down safety factor in this case can be said to clear a standard fall-down safety factor as 1.5.

Further, it is to be noted that the above result is obtained assuming that a ratio of a slope gradient of an embankment surface of the retaining wall Y of a leaning type with respect to an excavation gradient of an excavation surface thereof is set as 1:0.5, i.e. an angle of the inclination of the retaining wall Y is set as 26.565° with respect to its perpendicular plane.

It should be noted, however, that a slope gradient of the embankment surface of the retaining wall Y may become leaned toward a more risky side due to fall-down of its partial portion, in other words, that an angle of inclination of the slope of the embankment surface of the retaining wall Y may become greater than the ratio of the slope gradient of the embankment of the retaining wall Y of the leaning type with respect to a slope gradient of an excavation surface thereto. Therefore, assuming that a sliding surface having a ratio of the slope gradient of the block with respect to the slope gradient of the excavation surface thereof would shift from 1:05 (in the previous case) to a more risky side, i.e., for example 1:0.5 (an angle of inclination with respect to a perpendicular plane being 30.964°) due to a partial break of the block of the retaining wall Y, a fall-down safety factor "Fs'" can be calculated in a manner as will be described hereinafter.

In this case, an angle of inclination of a sliding surface, as referred as reference symbol "θ'", can be calculated as follows:

$$\theta' = 90° - \tan^{-1} 0.6 = 59.04°$$

Further, there can be calculated a weight of the earth, as referred to as "$\omega_3$", that applies pressure to a slope surface of the retaining wall leading to a partial breakdown of the block thereof as follows:

$$\omega_3=H^2\times(0.6-0.5)\times r/2=6.0^2\times(0.6-0.5)\times 2.0/2=3.6 \text{ tons per meter}$$

Thus, an earth pressure as referred to as "Pa3" caused to be applied thereto by the weight of the earth "TM3" can be calculated as follows:

$$\begin{aligned} Pa3 &= \omega_3\times\sin(\theta'-\delta')/\cos(\theta'-\delta'-\delta-\alpha) \\ &= 3.6\times\sin(59.04°-35°)/ \\ &\quad \cos(59.04°-35°-23.33°+26.565°) \\ &= 1.65 \text{ tons per meter.} \end{aligned}$$

Then, a fall-down moment, as referred to as "Mo2", to be caused by the earth pressure Pa3 can be calculated as follows:

$$Mo2=Po2\times H/3=1.65\times 6.0/3=3.3 \text{ tons·m/m}$$

Therefore, a fall-down moment, as referred to as "Mo", can be calculated as follows:

$$Mo=Mo1+Mo2=1.31+3.3=4.61 \text{ tons·m/m}$$

Then, a fall-down safety factor in this case, as referred to as "Fs'", can be given as follows:

$$Fs'=Mr/Mo=8.35/4.61=1.81$$

It can be noted herein that the fall-down safety factor Fs' in this case, too, clears a standard fall-down safety factor of 1.5.

Further, assuming that a collapse on the evacuated slope surface of the block of the retaining wall mainly occurs on a very small scale, for example, due to a fall of rock caused by freezing and melting or a break of the earth on the slope of the ground caused by weathering or other reasons, a fall-down safety factor of a leaning retaining wall Y of a type constructed with earths having a height "H" of 12.0 meters can be calculated in a manner as will be described hereinafter, provided that the amount of a backfilling material to be used for backfilling is an approximate figure and the other parameters are the same as those used for calculation of the fall-down safety factor Fs where the ratio of the slope gradient of the block of the retaining wall with respect to the slope gradient of the excavation thereof is set as 1:0.5 as described hereinabove and that they are otherwise specified hereinafter.

Thus, the weight of the backfilling material in the amount corresponding to the height H, as referred to as "$\omega_3$", can be obtained by equation (3") below by inserting the figures for the respective parameters into the above-defined equation (3) as follows:

$$\omega_2=H\times\omega_1=12.0\times 0.307=3.67 \text{ tons per meter} \quad (3")$$

Therefore, the total earth pressure of the backfilling material, "Pa1'", can be calculated by equation (4") below by inserting the corresponding parameters into the above-defined equation (4) as follows:

$$Pa1'=\omega_2\times\sin(\theta2-\phi)/\cos(\theta2-\phi-\delta-\alpha)=3.67\times\sin(48.186°-35°)/ \cos(48.186°-36°-23.33°+26.565°)=0.873 \text{ ton per meter} \quad (4")$$

Therefore, the fall-down moment to be applied by the total earth pressure of the backfilling material, Mo1', is then calculated by equation (5") below by inserting the corresponding parameters into the equation (5) above:

$$Mo'=Pa1'\times H/2=0.873\times 12.0/2=6.24 \text{ ton·m/m} \quad (5")$$

Furthermore, the resisting moment, "Mr'", is calculated by equation (6") as follows:

$$\begin{aligned} Mr &= H\times W\times(H/2\times\tan\alpha+Gx)+b^{2/2}\times \\ &\quad \tan\theta1\times r(H/2\times\tan\alpha+X) \\ &= 12.0\times 0.788\times(12.0/2\times\tan 26.565°+0.172)\times \\ &\quad 0.24^{2/2}\times\tan 63.435°\times 2.0\times(12.0/2\times \\ &\quad \tan 26.565°+0.42) \\ &= 30.78 \text{ ton}\cdot\text{m/m} \end{aligned}$$

Accordingly, a fall-down safety factor "Fs'" can be calculated by equation (7") below by inserting the fall-down moment "Mo'" and the resisting moment "Mr'", as obtained hereinabove, into the above-defined equation (7) as follows:

$$Fs=Mr'/Mo'=30.78/5.24=5.87 \quad (7")$$

This result means that the retaining wall Y as constructed using the blocks and by the method in accordance with the present invention can prevent a fall or break of the block thereof from occurring on the slope surface of the block on a small scale due to the leaning force applied by the block thereof.

It can be noted that no specific way of calculation is described hereinabove in the case where a tension is caused to occur toward the front wall side of the retaining wall Y of the leaning type. However, actually, it is apparent that such a tension is caused to occur toward the front wall side thereof on account of a horizontal force caused by a vibration in a horizontal direction due to an earthquake and a rotational moment, as referred to as –M, caused by an own weight of the retaining wall Y of the leaning type.

Accordingly, the retaining wall Y of the leaning type in accordance with the present invention can withstand against such a tension to a sufficiently high extent by disposing iron steel bars or rods F in the openings 4. The iron bar or rods F can function as reinforcement of the front wall side of the retaining wall.

Now, a description will be made of a block A and a retaining wall constructed with the block A in accordance with a seventh embodiment of the present invention with reference to FIGS. 32 to 40.

As shown in FIGS. 33 to 37, the block A according to the seventh embodiment of the present invention has substantially the same structure as the block A according to the first embodiment thereof, with the exception that the front wall portion is provided with no opening for insertion of iron bar or rods therethrough for reinforcement of the retaining wall in accordance with the present invention. In other words, it is of a backward leaning type and a plate form with its top portion located behind of its bottom portion and with its plate portion inclined backward at a predetermined angle of inclination and it comprises a front wall 1, a pair of left-hand and right-hand partition walls disposed on its left-hand and right-hand rear wall side portions and projecting backward, respectively, as referred to generally as 2, and a bottom plate 3 disposed integrally with a rear wall bottom portion and extending backward in a horizontal direction. Further, the partition walls 2 are formed over its entire vertical length integrally with the rear wall surface of the front wall 1 and over its entire depth integrally with the top plate surface of the bottom plate portion 3 with its rear edge plane agreeable equally to the rear edge plane of the bottom plate portion 3. In addition, each of the partition walls 2 is provided with a hollow opening, as referred to generally as 5, extending vertically over its entire length, through and within which iron bar or rods are disposed for reinforcement of the retaining wall Y of the leaning type.

Figure 38:
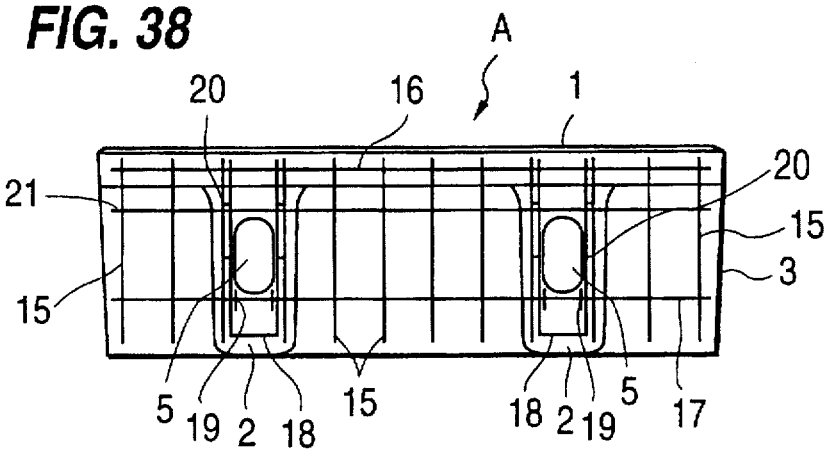
FIG. 38 is a top view showing the disposition of iron rods in the block therefor in accordance with the seventh embodiment thereof.
Figure 39:
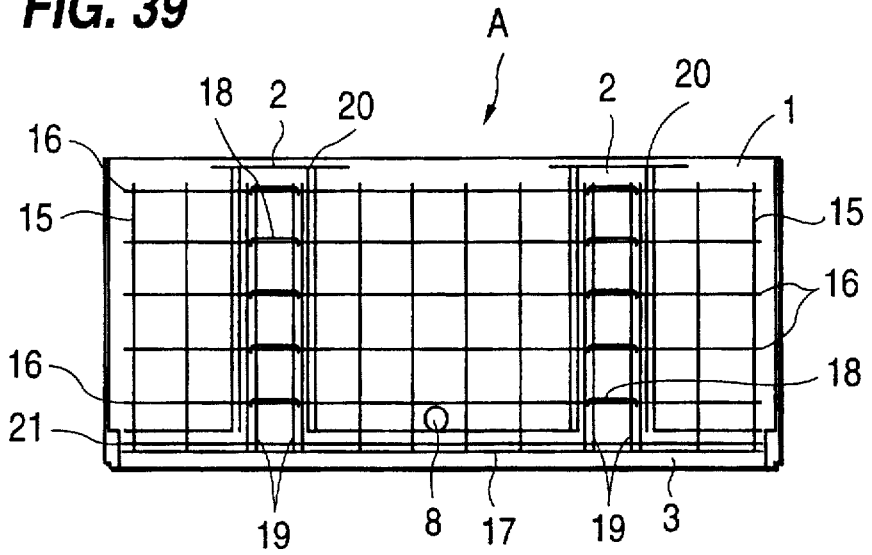
FIG. 39 is a rear view showing the disposition of iron rods in the block therefor in accordance with the seventh embodiment thereof.
Figure 40:
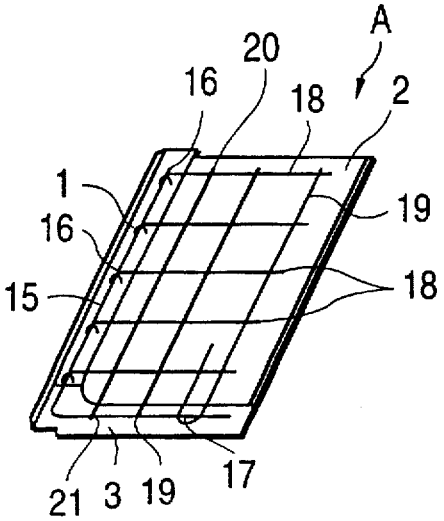
FIG. 40 is a side view showing the disposition of iron rods in the block therefor in accordance with the seventh embodiment thereof.
Figure 37:
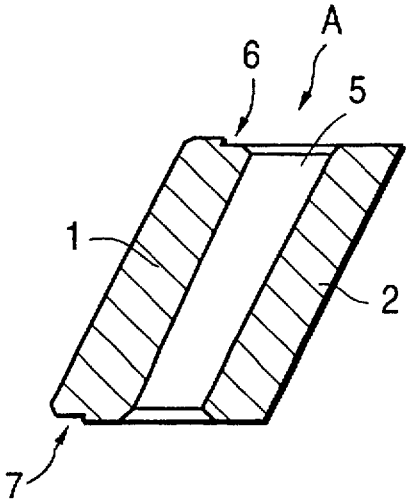
FIG. 37 is a side view in section showing the block therefor in accordance with the seventh embodiment thereof.

Then, a description will be made of the disposition of iron rods and wires in a block A. In the block A are disposed iron rods, as referred to as 15 to 21 in vertical, longitudinal and transverse directions. More specifically, as shown in FIGS. 38 to 40, for example, a plurality of main iron rods 15 each of a generally L-shaped form are disposed and embedded at constant intervals in the block A in such a manner that their vertical sections extend vertically over the approximately entire length of the front wall 1 thereof and that their horizontal sections extend horizontally over the approximately entire length there. Further, a plurality of main iron rods 16 are likewise disposed and embedded horizontally and transversely in vertical positions at constant intervals in the front wall 1 of the block A and each of the iron rods 16 is connected at its intersecting portions to the plurality of the iron rods 15 disposed in the front wall 1 thereof. Likewise, a main iron rod 17 is disposed and embedded horizontally and transversely on the rear portion of the bottom plate portion 3 of the block A and connected at its intersecting portions to the vertical sections of the iron rods 15 disposed i the bottom plate portion 3 thereof. In addition, an iron rod 21 is disposed and embedded horizontally and transversely on the front portion of the bottom plate portion 3 of the block A and connected at its intersecting portions to the horizontal foot sections of the iron rods 15 disposed in the bottom plate portion 3 thereof.

Furthermore, as shown in FIGS. 38 to 40, a plurality of iron rods are disposed and embedded inside each of the partition walls 2 of the block A in a manner as will be described hereinafter. A plurality of main iron rods 18 each in a U-shaped form are disposed in vertical positions of the partition wall 2 extending backward and horizontally in a longitudinal direction so as to enclose the opening 5 formed therein. Both end portions of the iron rod 18 are connected at their intersection portions to the iron rods 15 and 16 disposed in the front wall 1 of the block A. Further, for example, two of main iron rods 19 are disposed and embedded in left-hand and right-hand positions behind the opening 5, each extending vertically on the rear side of the partition wall 2. The vertically extending portion of the iron rod 19 is connected to the iron rods 18 and the lower section thereof in a U-shaped form is connected at its bottom portion to the iron rod 17. In addition, like the iron rods 19, a plurality of iron rods 20 are disposed vertically and embedded in each of the partition walls 2 at positions in front of the opening 5 and connected each at its bottom portion to the iron rods 15 and 21 and at its upper portions to the iron rods 18.

Although the numbers of the iron rods 15 to 21 may vary, for example, depending upon the size and kind of the block A, the block A as shown in FIGS. 38 to 40 is provided, for example, with twelve iron rods 15, five iron rods 16, one iron rod 17, five iron rods 18 for each partition wall 2, two iron rods 19 and 20 for each partition wall 2, and one iron rod 21.

In accordance with the seventh embodiment of the present invention, the block A having the iron rods disposed therein in the manner as described hereinabove can be prepared in a rigid structure by forming the front wall 1, the partition walls 2 and the bottom plant portion 3 in an integral manner, thereby enabling the physical strength to be enhanced to a remarkably high extent.

Figure 32:
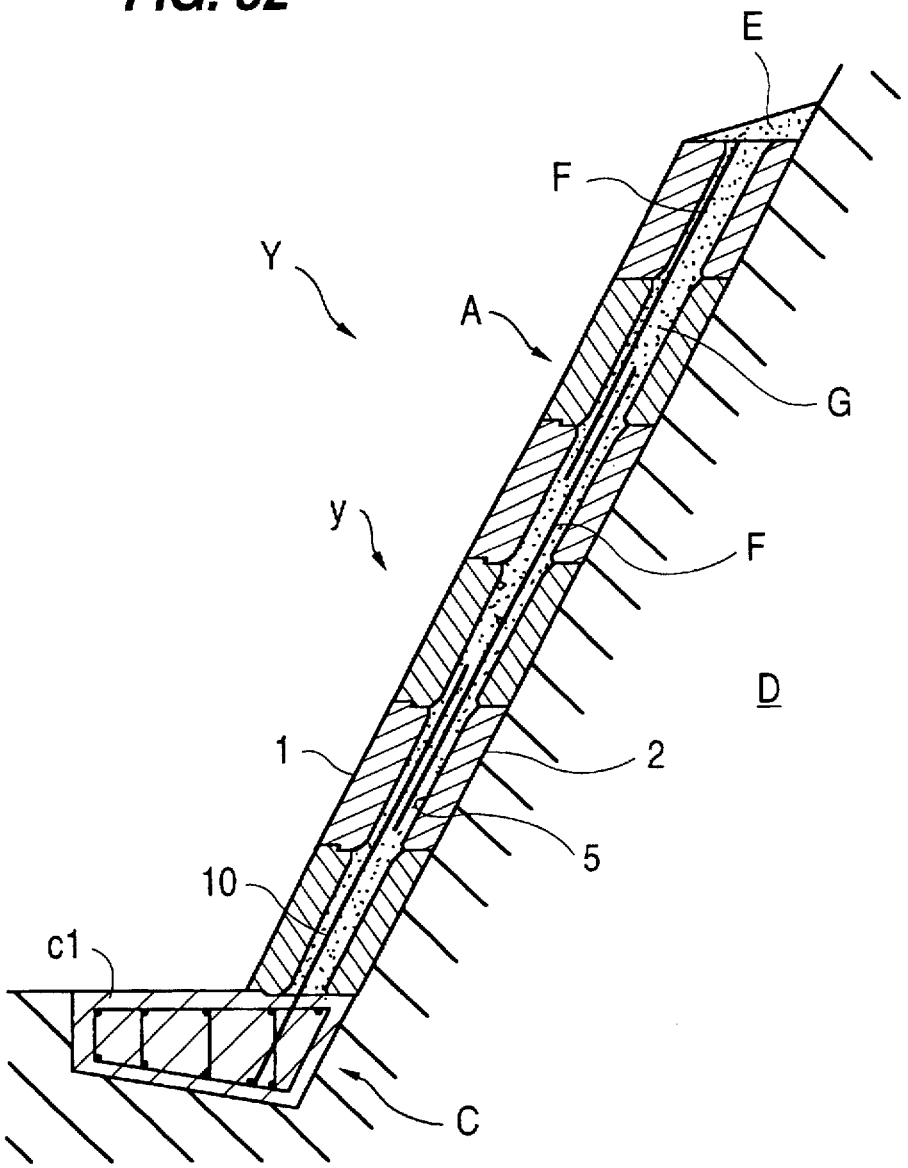
FIG. 32 is a side view in section showing a retaining wall of a leaning type constructed with blocks in accordance with a seventh embodiment of the present invention.
Figure 33:
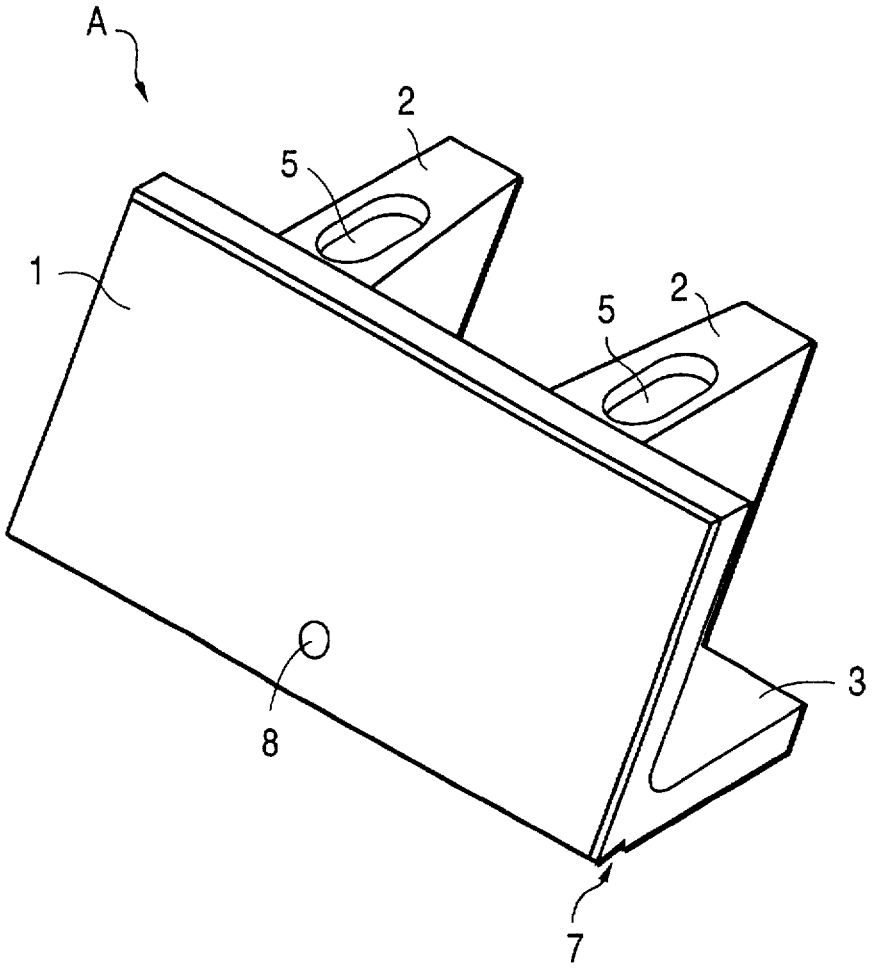
FIG. 33 is a perspective view showing a block for the retaining wall in accordance with the seventh embodiment thereof.
Figure 34:
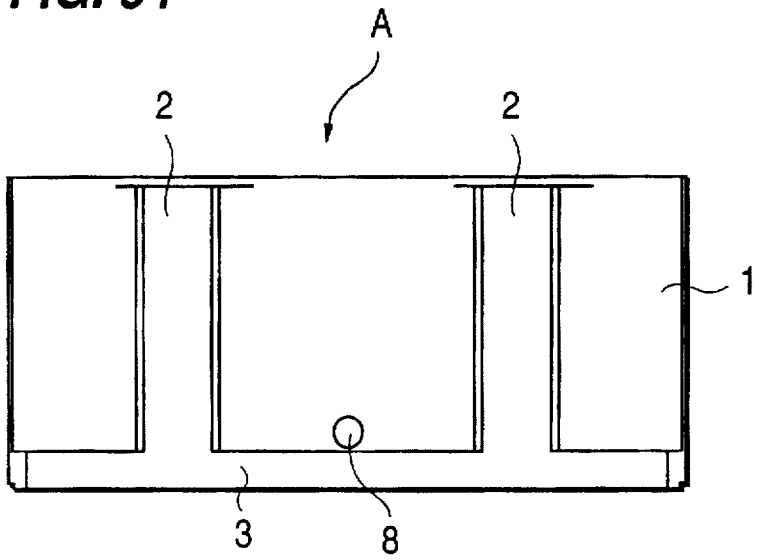
FIG. 34 is a rear view showing the block therefor in accordance with the seventh embodiment thereof.
Figure 35:
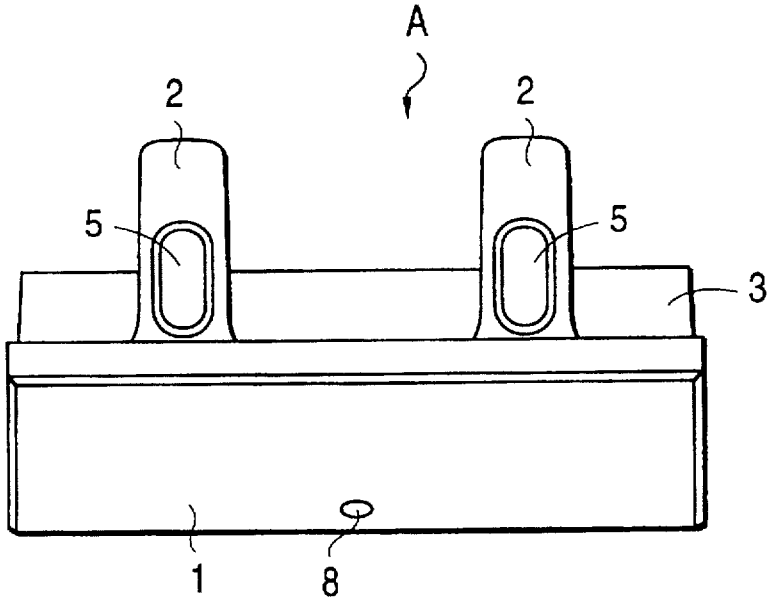
FIG. 35 is a top view showing the block therefor in accordance with the seventh embodiment thereof.
Figure 36:
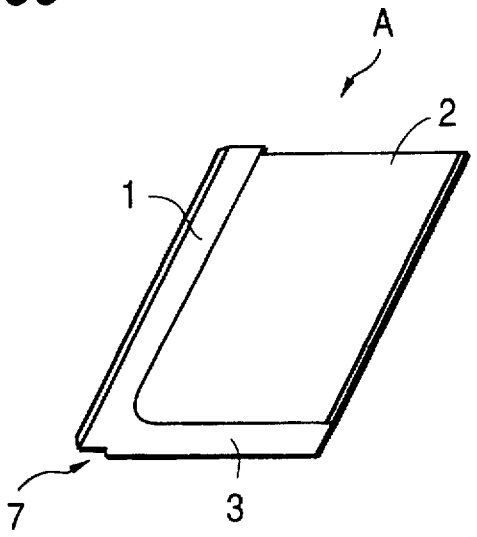
FIG. 36 is a side view showing a right-hand side of the block therefor in accordance with the seventh embodiment thereof.

As shown in FIG. 32, the blocks A can be constructed into a retaining wall Y of a leaning type according to the present invention in substantially the same manner as described hereinabove. Plural rows of the blocks A are laid integrally each onto the upper row of the blocks A, with iron rods 10 disposed inside the openings 5 of the partition walls 2 so as to connect the adjacent rows of the blocks A integrally to each other, thereby constructing the retaining wall as referred to as "y". The retaining wall y is then laid integrally on the upper surface of a footing foundation C into a retaining wall Y of a leaning type according to the seventh embodiment of the present invention. As the blocks A are formed each in a rigid structure as described hereinabove, the retaining wall Y itself is also formed in a rigid structure. Further, the footing foundation C is formed in such a manner that its front portion extends forward to be located sufficiently in front of the front foot portions of the retaining wall Y to form a front foot section, as referred to as c1, that can serve as increasing a resisting force to a fall-down of the retaining wall Y. This structure of the block A according to the seventh embodiment of the present invention allows the retaining wall Y to be constructed and built to a height as high as approximately two times to two and a half times that of retaining walls constructed in conventional manner.

Then, a description will be made of a block A according to an eighth embodiment of the present invention and a way of constructing a retaining wall Y according to the eight embodiment thereof with the blocks A thereof, with reference to FIGS. 41 to 48. As the block A according to the eighth embodiment of the present invention has substantially the same structure as that of the blocks A according to the previous embodiments of the present invention, particularly as that of the block A according to the seventh embodiment thereof, the same and similar elements are provided with the same reference numerals and symbols and a duplicate description will be omitted for brevity of explanation. Hence, a description will be made of the elements that differ from those of the previous embodiments and that have functions different therefrom.

As shown in FIGS. 42 to 45, the front wall 1 of the block A are provided with two partition walls, as referred to generally as 2, on the left-hand and right-hand rear wall sides, the front edges of which are formed integrally with the rear wall surfaces and which extend horizontally and longitudinally in a backward direction over substantially the entire length of the bottom plate portion 3. Further, each of the partition walls 2 is provided with two openings, as referred to generally as 5, which is formed in a rectangular shape with its four corners rounded and located in a longitudinal direction and which extends vertically over the entire length thereof. The opening 5 further extends straight through the bottom plate portion 3 so as to communicate the top surface of the partition wall 2 with the bottom surface of the bottom plate portion 3, within and through which iron rods are disposed in a similar and conventional manner as described hereinabove.

Further, a description will be made of a manner in which iron rods are disposed in the block A according to the eighth embodiment of the present invention with reference to FIGS. 45 to 48. As the iron rods may be disposed for the block A according to the eight embodiment of the present invention in substantially the same manner as the iron rods are disposed for the block A according to the seventh embodiment thereof, a specific description will be made hereinafter of the elements that differ from those of the block A of the seventh embodiment thereof.

As two of the openings 5 are provided in each of the partition walls 2 of the block A of this embodiment, the longitudinal length of the partition wall 2 is made longer than the partition wall 2 of the partition wall 2 having one opening 5 according to the previous embodiments of the present invention. Given the foregoing, a further number of iron rods are disposed for this block A in addition to the block A according to the seventh embodiment, in order to enhance the physical strength of the block A as a whole.

Specifically, two iron rods 16 are disposed in the front wall 1, while the second one is disposed behind the first one corresponding to the iron rod 16 in the seventh embodiment thereof and it is connected to the iron rods 15 in the same manner as the first one. Each one of the iron rods 17 and 21 is disposed extending horizontally and transversely over the entire width of the bottom plate portion 3 so as to pass through the two partition walls 2, in addition to the iron rods 17 and 21 in the seventh embodiment thereof. Further, the iron rod 18 in a U-shaped form is disposed so as to enclose the two partition walls 2 and their free edge portions of the iron rod 18 are connected each at one position to the iron rod 15 and at two positions to the iron rods 16. An additional pair of iron rods 19 are disposed between the two openings 5 in each of the partition wall 2 in the same manner as described hereinabove. In addition, for example, four iron rods 20 are disposed in the front wall 1 so as to be connected each to two iron rods 15 located at its both side ends and at its middle locations. Furthermore, two iron rods 20 are disposed within each of side wall portions of each of the partition walls 2.

In this embodiment, the side walls of the partition walls 2 facing each other are formed so as to become tapered with the opposite side walls thereof extending straight at right angles with respect the rear wall surface of the front wall 1, in other words, so as to allow the transverse thickness of one of the partition walls 2 to become gradually smaller as the partition wall 2 is located farther behind.

By constructing a retaining wall Y according to the eighth embodiment of the present invention in a rigid structure with the blocks A having the structure as described hereinabove in substantially the same manner as the retaining wall Y according to the seventh embodiment thereof is constructed, the resulting retaining wall Y of the eighth embodiment can be provided with a highly improved degree of physical strength against a force sliding in a forward direction, thereby leading eventually to a fall-down of the retaining wall.

Figure 41:
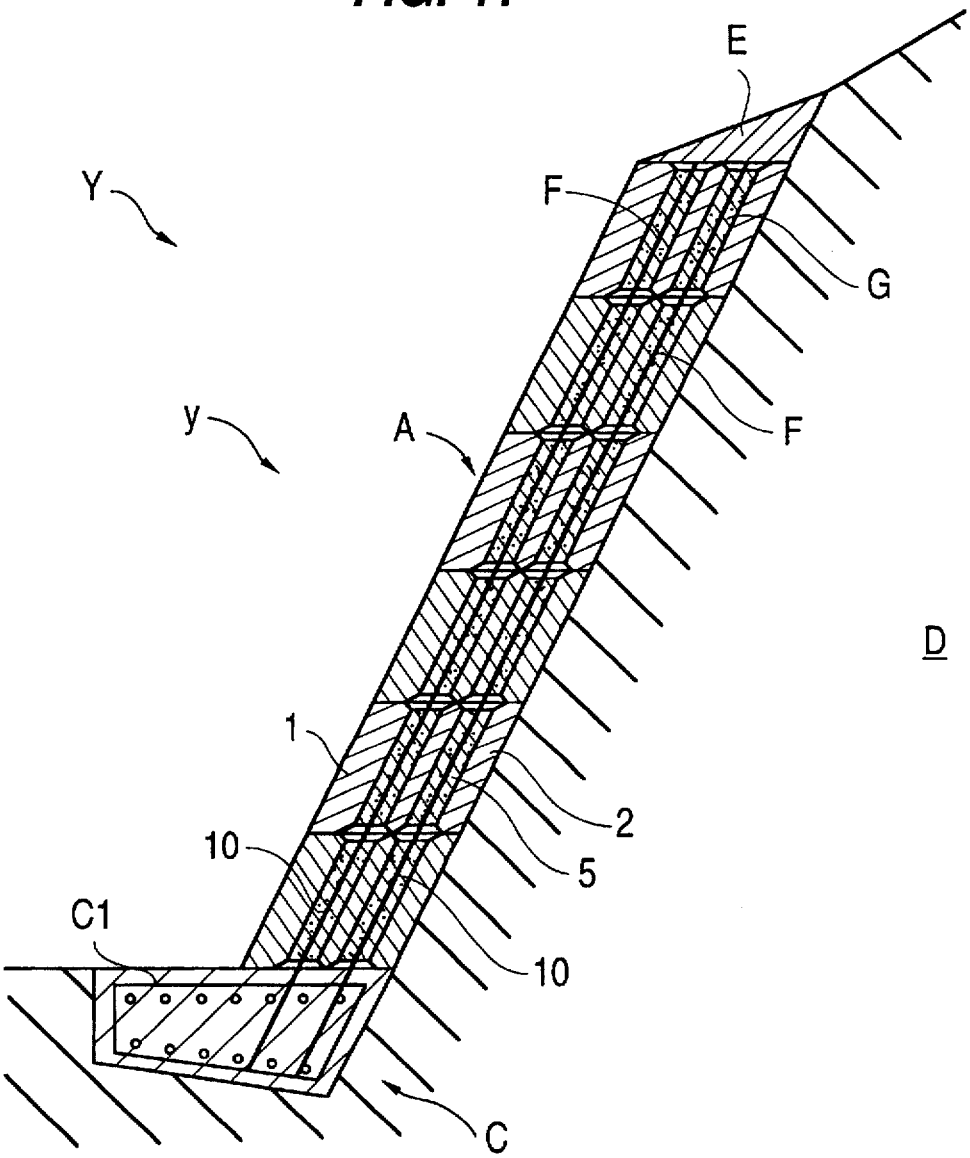
FIG. 41 is a side view in section showing a retaining wall of a leaning type constructed with blocks in accordance with an eighth embodiment of the present invention.
Figure 42:
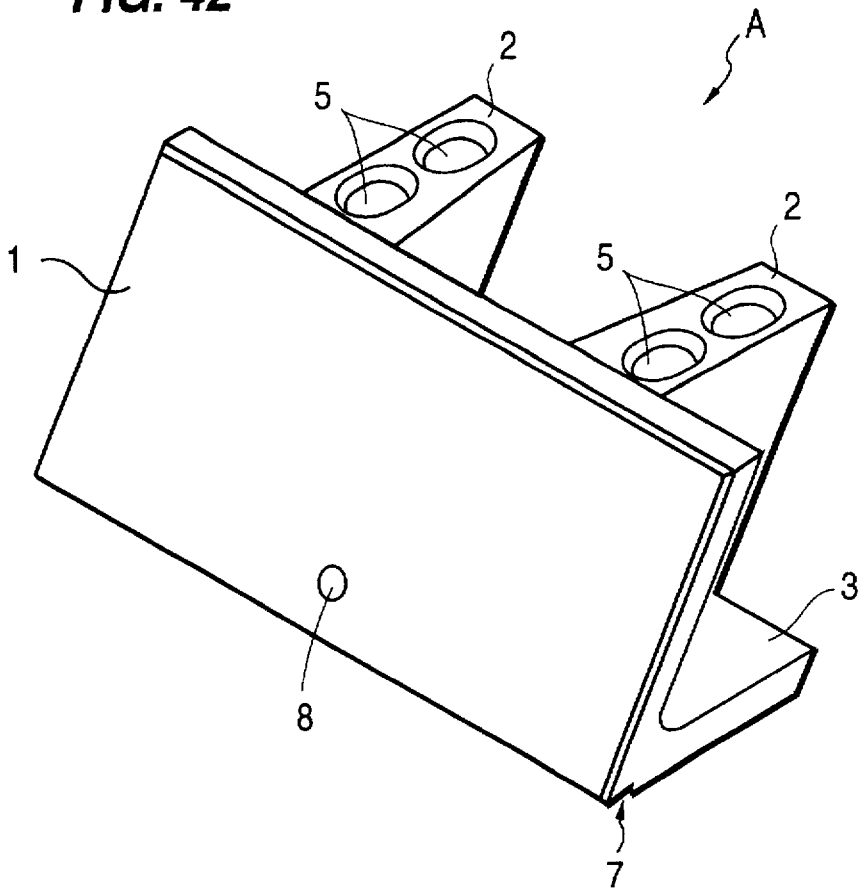
FIG. 42 is a perspective view showing a block for the retaining wall in accordance with the eighth embodiment thereof.
Figure 43:
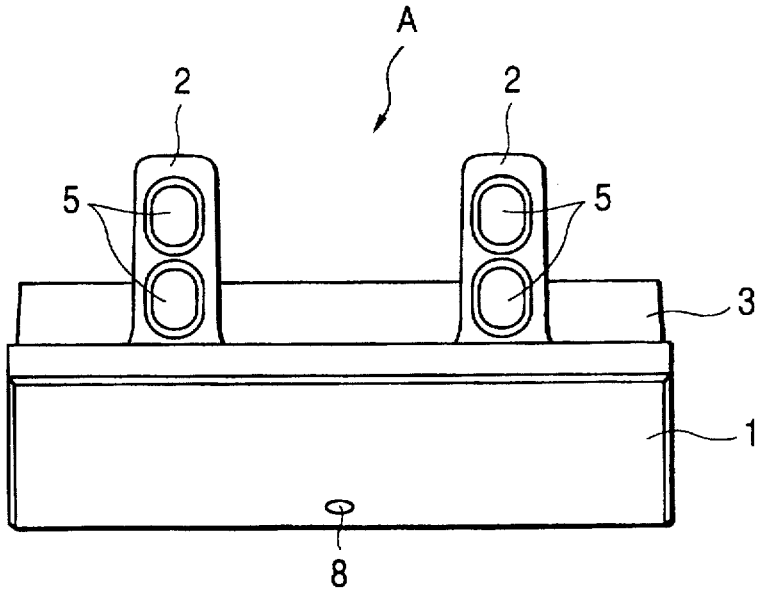
FIG. 43 is a top view showing the block therefor in accordance with the eighth embodiment thereof.
Figure 45:
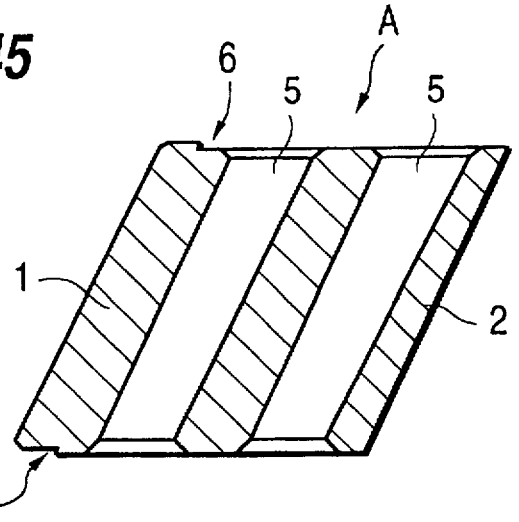
FIG. 45 is a side view in section showing the block therefor in accordance with the eighth embodiment thereof.
Figure 44:
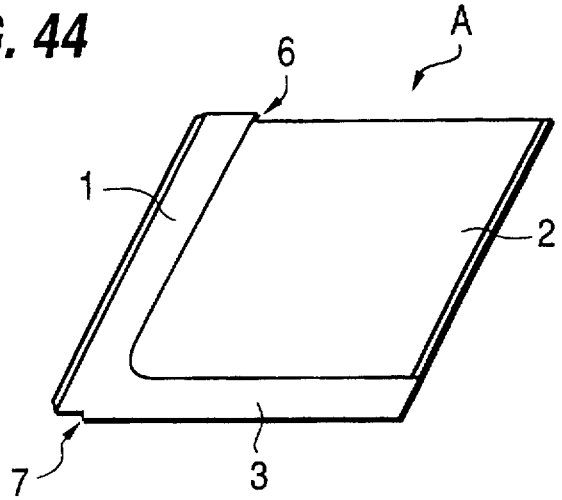
FIG. 44 is a side view showing a right-hand side of the block therefor in accordance with the eighth embodiment thereof.
Figure 48:
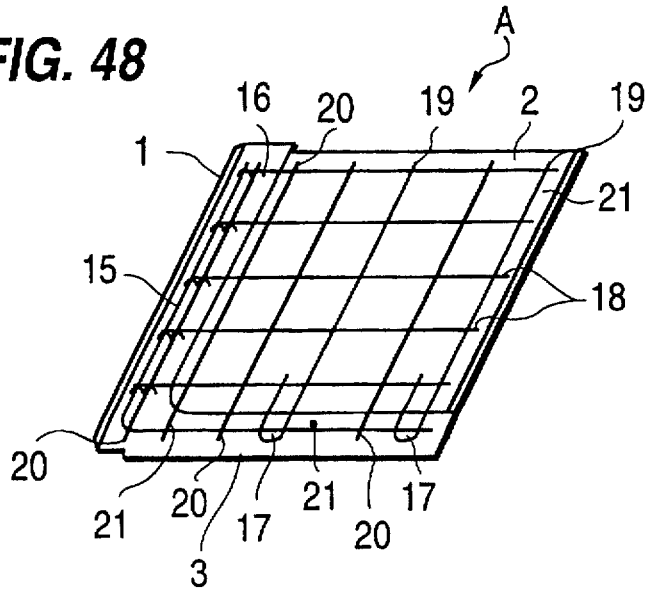
FIG. 48 is a rear view showing the disposition of iron rods in the block therefor in accordance with the eighth embodiment thereof.
Figure 46:
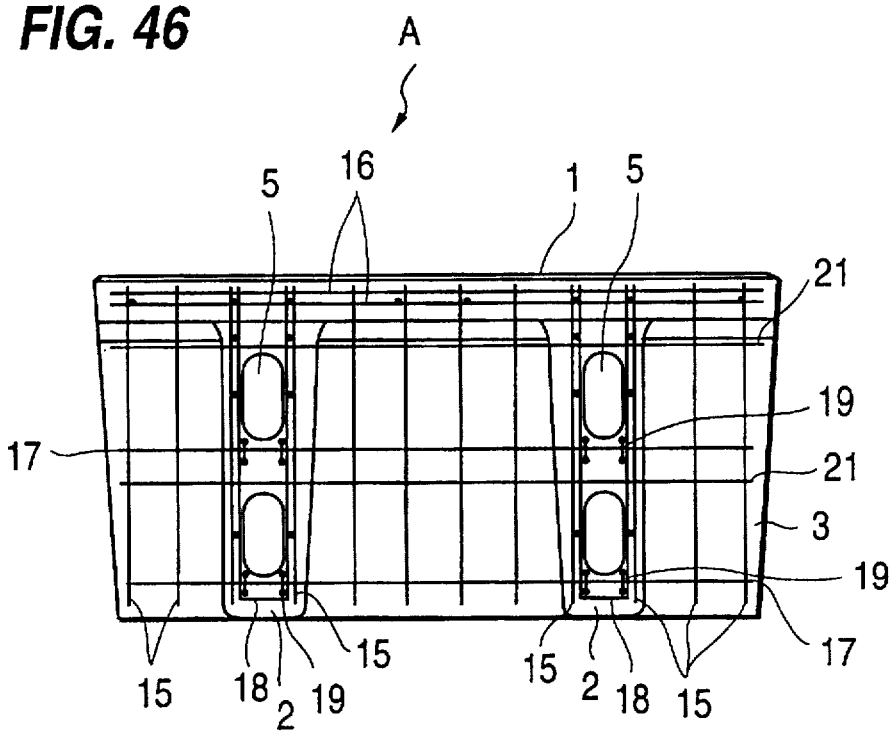
FIG. 46 is a side view in section showing the disposition of iron rods in the block therefor in accordance with the eighth embodiment thereof.
Figure 47:
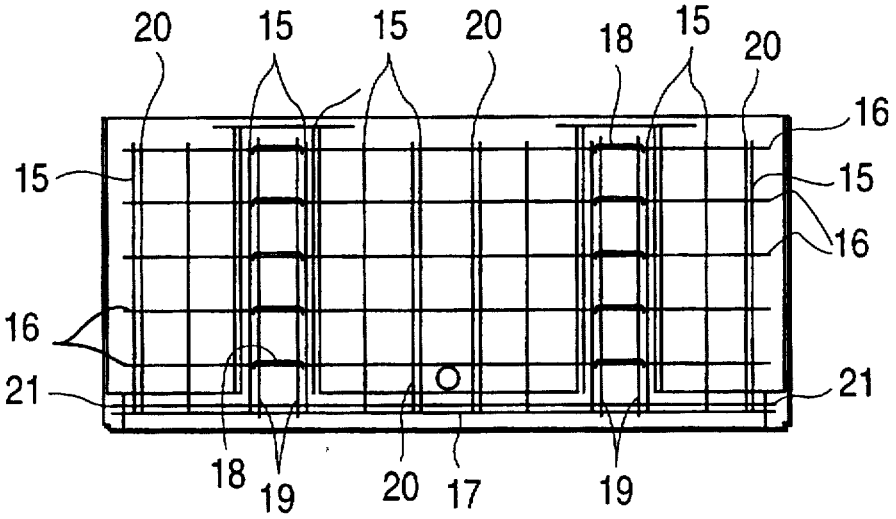
FIG. 47 is a top view showing the disposition of iron rods in the block therefor in accordance with the eighth embodiment thereof.

More specifically, the retaining wall Y may be constructed with the blocks A according to the eighth embodiment of the present invention in substantially the same manner as the retaining walls Y according to the previous embodiments thereof as described hereinabove. As shown in FIG. 41, the lowest row of the blocks A is laid onto the rear surface portion of the footing foundation C and the upper rows of the blocks are laid onto the next lower rods of the blocks A, thereby constructing a the retaining wall "y" according to the eighth embodiment thereof. By inserting iron rods 10 and F into each of the openings 5 of the partition walls 2, connecting the iron rod F to the iron rod 10 and by filling the openings 5 with the filling material G, the retaining wall y is then constructed on the footing foundation C, thereby resulting in the formation of the retaining wall Y in a rigid structure having a highly improved physical strength against the force to be applied forward from the earth behind of the retaining wall. Like the footing foundation C of the retaining wall Y in accordance with the seventh embodiment, the footing foundation C in this embodiment is formed with a foot section, as referred to as "C1", extending forward from the foot portion of the retaining wall y, thereby increasing the force resisting to the forward sliding force applied thereto resulting eventually to a fall-down of the retaining wall. This structure of the retaining wall Y can enhance the physical strength, thereby enabling the height of the retaining wall Y to become higher by approximately two times to two and a half times those constructed in conventional manner.

It is to be noted herein that, for example, the numbers and intervals of the iron rods for the blocks A according to the seventh and eighth embodiments of the present invention may vary appropriately depending upon a physical strength of the block A and the retaining wall resulting therefrom. It is also to be noted, however, that, for the blocks A in the seventh and eighth embodiments of the present invention, the shape of the partition wall 2 is note limited to such a particular one and it may appropriately vary, for example, with the usage or kinds of the blocks A and the retaining wall Y to be constructed therewith. More specifically, for example, each of the partition walls 2 may be formed in such a manner that its inner side wall portion may be made straight at an angle right to the rear wall surface of the front wall 1 or its outer side wall portion may be tapered so as to decrease the transverse thickness or width of the corresponding partition wall 2.

Each of the blocks A according to the seventh and eighth embodiments of the present invention is useful particularly for the construction of an embankment such as the retaining wall Y according to the respective embodiment thereof at a location where the earth pressure is supposed to be so high and where conditions for construction at side are likely to be so severe.

It is further to be noted that, although the retaining wall Y according to each of the embodiments of the present invention as described hereinabove is constructed as a high as the excavated ground D, a height of the retaining wall Y may be set to be lower than that of the excavated ground D. It can be additionally noted that a slope gradient of the embankment of the retaining wall Y of a leaning type according to the present invention may be set within a clearance ranging, for example, from 1 to 0.3 to 1 to 0.6.

Figure 49:
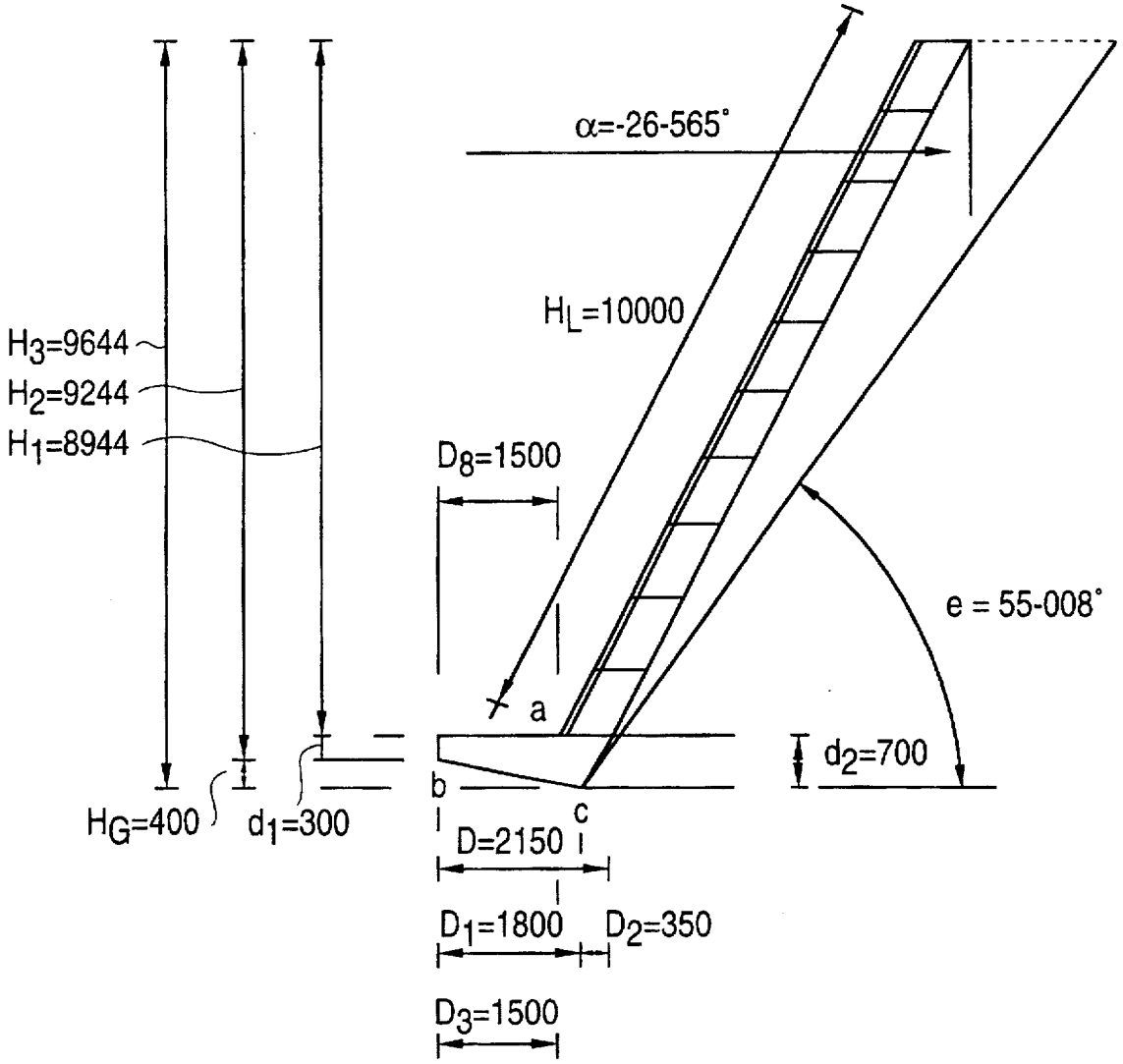
FIG. 49 is an explanatory side view in section showing a side of a retaining wall of a leaning type in accordance with the present invention.

Now, a fall-down safety factor of the retaining wall Y according to the seventh embodiment of the present invention will be calculated in accordance with a series of equations as described hereinabove, with reference to FIG. 49. It should be noted herein that a fall-down safety factor "Fr" be higher than 1.5 and further that a condition of safety against a fall-down is such that the point of action of a resultant force of an entire load at a bottom surface of the footing foundation should be located in a position within one sixth of the width of the bottom surface of the footing foundation when measured from the center of the footing foundation.

First, there are calculated earth pressure coefficients, i.e. $K_A$, $K_H$ and $K_V$, in a manner as follows:

$$\begin{aligned} K_A &= \sin(\theta-\delta'')/\cos(\theta-\phi-\delta'-\alpha)\times(\cot\theta+\tan\alpha) \\ &= \sin(55.008^\circ-35^\circ)/\cos(55.008^\circ-35^\circ-23.33^\circ+26.565^\circ)\times \\ &\quad (\cot 55.008^\circ-\tan 26.565^\circ) \\ &= 0.34215/0.91884\times(0.7-0.5)=0.074 \end{aligned}$$

$$\begin{aligned} K_H &= K_A\times\cos(\delta'+\alpha) \\ &= 0.074\times\cos(23.33^\circ-26.565^\circ) \\ &= 0.074\times\cos 0^\circ=0.074\times 1.0=0.074 \end{aligned}$$

-continued $$K_V = K_A \times \sin(\delta' + \alpha) = 0.074 \times \sin(23.33° - 26.565°) = 0.074 \times \sin 0° = 0$$

wherein reference symbol "θ" is an angle of a virtually sliding plane with respect to a horizontal plane, which is set in the above equation to be 55.008°;

reference symbol "δ"" is an angle of sliding friction at an excavated ground surface on the rear side of the retaining wall, which is set herein to be 35°;

reference symbol "ϕ" is an angle of internal friction of the earth laid on the ground on the rear side of the retaining wall, which is equal to the angle of sliding friction, "α", and which is so set as 36°; and reference symbol "δ'" is an angle of friction between the rear edge of the bottom plate and the earth laid on the rear side of the retaining wall and set herein as ⅔×ϕ, so it is set herein as 23.33°.

Further, there are then calculated an earth pressure "$P_{aH}$" and a fall-down moment "Ma" at the point of origin, as referred to as "a", by the following equations:

$$P_{aH} = r \times H1^{2/2} \times K_H = 2.00 \times 8.944^{2/} \times 0.074 = 5.92 \text{ tons per meter; and}$$

$$Ma = P_{aH} \times H1/3 = 5.92 \times 8.944/3 = 17.65 \text{ ton} \cdot \text{m/m}$$

wherein reference symbol "r" is a unit weight of the backfilling earth and is set herein to be 2.00 tones per cubic meter; and reference symbol "H1" is a perpendicular height of a length "$H_L$" (which is set herein to be 10.00 meters) of the slope of the retaining wall constructed with the blocks and is calculated by $H1=H_L \times \cos\alpha(=10.00 \times \cos 26.565°=8.944$ meters).

Then, there are calculated a resisting moment "Mar" and a safety factor "Fr" at the point of origin "a" in a manner as will be described hereinafter:

First, an entire weight of the retaining wall, as referred to as "Wc", is calculated as follows:

$$Wc=W \times H_L=0.693 \times 10.00=6.93 \text{ tons per meter}$$

wherein reference symbol "W" is a weight of the backfilled earth per cubic meters, which is set herein as 0.693 ton per cubic meters.

Then, an entire weight of the earth placed on the bottom plate per square meter, as referred to as "We", can be calculated as follows:

$$We=H_L \times \omega=10.00 \times 0.327=3.27 \text{ tons per meter}$$

wherein reference symbol "ω" is a weight of the backfilled earth per meter and set herein as 0.327 ton per meter.

Thereafter, the resisting moment can be obtained by the following equation:

$$Mar=Mar1+Mar2$$

wherein a moment section Mar1 is obtained as follows:

$$Mar1 = Wc \times (H1/2 \times \tan\alpha + Gx) = 6.93 \times (8.944/2 \times \tan 26.565° + 0.245) = 17.19 \text{ tons} \cdot \text{m/m},$$

wherein reference symbol "Gx" is a distance from the front surface of the front wall to the gravity of the block and set herein as 0.245 meter;

and another moment section Mar2 is obtained as follows:

$$Mar2 = We \times (H1/2 \times \tan\alpha + X) = 3.27 \times (8.944/2 \times \tan 26.565° + 0.533) = 26.24 \text{ ton} \cdot \text{m/m},$$

wherein reference symbol "X" i a distance from the front surface of the front wall to the gravity of the backfilled earth and set herein as 0.533 meter.

Thus, the resisting moment Mar is obtained as follows:

$$Mar=Mar1+Mar2=26.24 \text{ tons} \cdot \text{m/m}$$

Therefore, the safety factor "Fr" can be calculated as follows:

$$Fr=Mar/Ma=26.24/17.65$$

However, the safety factor Fr in this case is lower than a standard fall-down safety factor of 1.5. This indicates that the structure of the retaining wall along cannot ensure a sufficient extent of safety so that a fall-down safety factor will be calculated again when the retaining wall Y constructed integrally with the footing foundation C is formed as a rigid structure.

For re-calculation, there is obtained a total perpendicular load acting upon the retaining wall, as referred to as "Na", by the following equation:

$$Na=Wc+We=6.93+3.27=10.20 \text{ tons per meter}$$

Further, there is obtained a mean distance (arm) ranging from a moment axis to the point of action of the load, as referred to as "X", by the following equation:

$$X=Mar/Na=26.24/10.20=2.57 \text{ meters}$$

Then, there are calculated an earth pressure "$P_{bH}$" and a fall-down moment "Mb" at the point of origin "b" in a manner as follows:

$$P_{bH}=r \times H2^2/2 \times K_H=2.0 \times 9.244^2/2 \times 0.074=6.32 \text{ tons per meter}$$

wherein reference symbol "H2" is a perpendicular height corresponding to a combination of the retaining wall section "y" with the footing foundation C and it is set as 9.244 meters.

At this time, the fall-down moment "Mb" can be calculated by the following equation:

$$Mb=P_{bH} \times H2/3=6.32 \times 9.244/3=19.47 \text{ tons} \cdot \text{m/m}$$

Further, the perpendicular force "Nb" and the resisting moment "Mbr" at the point of origin "b" are calculated as follows:

| Items | Equation | Nb (t/m) | X (m) | Mbr (t · m/m) |
|---|---|---|---|---|
| Retaining wall "y" | Nb = Na (see above) | 10.20 | $\bar{X}$ + D3 = 4.07 | 41.514 |
| Footing foundation C | D × d2 × Ws = 2.15 × 0.7 × 2.5 | 3.763 | 1.075 | 4.045 |
| Σ1 | | 13.963 | | 45.559 |
| Footing foundation C | $D_2^2$ × tan α × 1/2 × Ws = $0.72^2$ = tan 26.565° × 1/2 × 2.5 | 0.306 | 2.033 | 0.622 |
| Footing foundation C | D1 × $H_G$ × 1/2 × Ws = 1.8 × 0.4 × 1/2 × 2.5 | 0.900 | 0.600 | 0.540 |
| Σ2 | | 1.206 | | 1.162 |
| Σ3 | Σ1−Σ2 | 12.757 | | 44.397 |

From the foregoing, the fall-down safety factor Fr at the point of origin "b" can be calculated as follows:

$$Fr=Mbr/Mb=44.397/19.47=2.28$$

This fall-down safety factor Fr is acceptable because it is higher than a standard fall-down safety factor of 1.5.

Further, the following is obtained:

$$Xo=(Mbr-Mr)/Nb=(44.397-19.47)/12.757=1.95 \text{ meters; and}$$

$$e=D1/2-Xo=1.8/2-1.95=-1.05 \text{ meter}$$

This figure is acceptable because it is smaller than a figure obtainable by equation:

$$D1/6=1.8/6=0.3 \text{ meter}$$

Furthermore, an earth pressure "PcH" and a slide safety factor "Fs" at the point of origin "c" are calculated as follows:

$$P_{cH=\gamma\times H}3^2/2\times K_H=2.0\times 9.644^2/2\times 0.074 \leqq 6.88 \text{ tons per meter}$$

Thus, the slide safety factor Fs is calculated by an equation as follows:

$$Fs=(Nb\times\cos\beta o+P_{cH\times}\sin\beta o)\times\mu/(P_{cH\times}\cos\beta o-Nb\times\sin\beta o)$$

where $\beta o=\tan^{-1} H_G/D=\tan^{-1} 400/1800=12.53°$; and reference symbol "ω" is a friction coefficient between the bottom surface of the footing foundation and the ground supporting the footing foundation and it is set herein as 0.6.

Therefore, the slide safety factor Fs is given as follows:

$$\begin{aligned} FS &= (12.757\times\cos 12.53° + 6.88\times\sin 12.53°)\times \\ &\quad 0.6/(6.88\times\cos 12.53° - 12.757\times\sin 12.53°) \\ &= 2.12. \end{aligned}$$

It is now found that the slide safety factor Fs clears a standard safety factor of 1.5, like the fall-down safety factor Fr as described hereinabove.

It is to be noted herein that each of the parts and members to be employed for the retaining wall is calculated for its intensity of stress from its sectional force on the basis of the theory of elasticity and further that the calculated intensity of stress is investigated by the method of allowable unit stress.

Further, it is to be noted that the opening 5 of the partition wall 2 for insertion of the iron bars or rods is in a rectangular shape with its both left-hand and right-hand sides longer than its both front and rear sides and that in usual cases an anchoring iron bar or rod or a connecting iron bar or rod 10 are disposed in middle positions behind and ahead of the opening 5. As needed, however, it is possible to insert such iron bars or rods at the front side of the opening 5.

It is also be noted that the foregoing is applicable to the partition wall 2 having plural openings 5. This kind of the block is useful particularly for the construction of an embankment at a location, for example, where an earth pressure is likely to be so high or where conditions for constructions are likely to be so severe.

EFFECTS OF THE INVENTION

As the blocks for the retaining wall of the leaning type in accordance with the present invention comprises the front wall, the partition wall formed integrally with the front wall and projecting from the rear wall surface of the front wall and the bottom plate portion formed integrally with the bottom portion of the rear wall surface of the front wall and extending backward, the width of the ground to be excavated on the side surface of the ground can be made shorter than in the case of the construction of conventional the retaining walls, when the retaining wall of the leaning type according to the present invention is constructed with the blocks along the cut surface of the excavated ground. Further, there may be employed the backfilling material having a high water permeability, such as a cobblestone or a crushed stone, for backfilling the rear side of the retaining wall. The usage of the blocks according to the present invention can minimize the amount of the earth to be excavated and the amount of the backfilling material. Therefore, costs for the construction of the retaining wall can be saved. Further, an earth pressure acting upon the retaining wall can be decreased.

As the block is provided at its front wall with a single opening or plural openings extending vertically over its entire length, the retaining wall of the leaning type constructed with the blocks has the iron bars or rods inserted and disposed within the openings through all the blocks over the entire length of the retaining wall. The openings are further filled in with the filling and solidifying material, such as cement or mortar, in order to connect and fix the vertical rows of the blocks to each other, thereby forming a rigid structure having a high resistance to tension and preventing the resulting retaining wall from swelling or projecting forward at its middle portion.

Therefore, even if a break of the cut slope of the ground would be caused to occur on a small scale due to an outflow of rain water or for other reasons or a fall of the earth on the ground behind the embankment of the retaining wall would be caused to occur by a repetition of freezing and melting, the leaning force to be applied by the retaining wall of the leaning type can prevent the cut slope surface of the excavated ground from being further broken resulting eventually into a large-scale fall-down of the retaining wall. In addition, the reaction force from the cut slope surface can be produced, thereby preventing a break of a small portion of the retaining wall or a small-scale fall of the earth from occurring beforehand. Furthermore, costs of maintenance or safety can be saved.

Further, as the block according to the present invention is provided at the partition wall portion with a single opening or plural openings extending vertically over its entire length and the rows of the blocks are connected to each other by inserting iron bars or rods through the openings and filling the openings with the filling and solidifying material, such as cement or mortar, the resulting retaining wall can be made a rigid structure having a higher resistance to tension. The retaining wall according to the present invention can improve its functions for preventing a slope of the ground or the like from being broken.

In addition, as the block according to the present invention has the bottom plate portion connected integrally to the bottom rear wall portion of the front wall and extending backward, the load is imposed upon the bottom plate portion when the rear side is backfilled with the backfilling material such as cobblestone or cut earth, thereby acting the negative moment of rotation in a direction causing the retaining wall to push backward. Hence, on the contrary, a moment of resistance to a fall-down is increased, thereby making a fall-down safety factor higher.

Still further, as the block has the partition wall fixed integrally to the rear wall surface of the front wall on its front side and to the upper wall surface of the bottom plate portion on its bottom side as well as the bottom plate portion fixed integrally to the rear wall bottom portion of the front wall, the block itself has a high resistance to tension. As at least either of the front all or the partition wall is provided with a single opening or plural openings extending vertically over the entire length of the front wall and/or the partition wall, through which the iron bars or rods are to be inserted through the openings, the block itself can be made so highly rigid that the resulting retaining wall can ensure a sufficient extent of the physical strength. Further, as a number of iron bars or rods are disposed inside the front wall, the partition walls and the bottom plate portion in vertical, transverse and longitudinal directions, the physical strength of the block can be further improved, thereby leading to reinforcement of the retaining wall constructed with the blocks to a further extent.

Furthermore, as the front wall of the block is disposed with its upper portion leaning backward at a predetermined angle of inclination so as to allow a slope gradient of the front wall to adapt to a slope plane of the ground, when placed on a horizontal plane, the blocks can be laid onto another blocks to form a retaining wall simply by laying an upper row of the blocks onto a lower row of the blocks so as to cause the bottom front edge of each of the blocks in the upper row to adapt to the top front edge of each of the blocks and placing the bottom plate portion onto the partition walls of the blocks in the lower row. The blocks having the structure as described hereinabove can be laid on another blocks with extreme ease, thereby forming the retaining wall according to the present invention.

In addition, the block is provided with the top step portion at the boundary between the rear wall of the front wall and the partition wall in such a manner that the top rear wall edge of the front wall is located in a position higher to some extent than the top front edge of the partition wall. Likewise, it is provided with the bottom step portion at the boundary of the bottom plane of the front wall and the bottom plane of the bottom plate portion in such a manner that the rear bottom edge of the front wall is located in a position higher than the upper front side of the bottom plate portion. Thus, the top step portion of the block can adapt to and engage tightly with the bottom step portion of the block to be laid thereonto and, likewise, the bottom step portion of the block can adapt to and engage tightly with the top step portion of the block to be laid thereunder, thereby helping the top step portion of the block prevent the block laid thereonto from sliding in a forward direction and the bottom step portion of the block prevent the block itself from sliding forward. As a result, the retaining wall of the leaning type constructed with the blocks as a whole can be prevented from sliding forward due to the earth pressure applied from the rear.

As the front wall has its left-hand and right-hand sides tapered backward so as to decrease the width gradually smaller and the bottom plate portion likewise has its left-hand and right-hand sides tapered backward in a similar manner so as to be associated with the front wall, the retaining wall can be constructed so as to adapt to a curved slope plane of the ground, such as a side wall of a road wall to be constructed in conventional manner.

Further, as the retaining wall according to the present invention may be constructed or built in such a staggered fashion that each of the blocks of an upper row is laid onto bridging two pieces of the blocks of a lower row, it can sustain its physical strength against a fall-down resisting to the external force from the ground side.

Still further, as the retaining wall according to the present invention may be constructed or built with the blocks different size in such a way that the blocks having a larger size, i.e. having a heavier weight, are placed in an upper row onto the blocks having a smaller size, i.e. having a lighter weight, are placed in a lower row, it can be made its rearward side heavier than its forward side, thereby enabling the retaining wall to be made stabler as a whole and to withstand against the earth pressure to be applied forward from the rear.

What is claimed is:

1. A block for a retaining wall of a leaning type comprising:

a front wall having an upper portion and a lower portion, the front wall leaning gradually in a backward direction from the lower portion to the upper portion;

a bottom plate connected integrally to the lower portion of said front wall and extending backward from a rear portion of said front wall; and a partition wall extending vertically and integrally along the rear portion of said front wall, a bottom side of said partition wall being disposed integrally with said bottom plate, wherein at least one of said front wall and said partition wall is provided with an opening which extends vertically over an entire length thereof and which is adapted to receive a rod therein.

2. The block as claimed in claim 1, wherein said partition wall is provided with a plurality of openings each of which extends vertically over the entire length of said partition wall and each of which is adapted to receive a rod therein.

3. The block as claimed in claim 1, wherein:

a first set of rods is embedded inside said front wall in vertical and transverse direction;

a second set of rods is embedded inside said partition wall in vertical and transverse directions; and a third set of rods is embedded inside said bottom plate.

4. The block as claimed in claim 2, wherein:

said partition wall is connected to the rear portion of the front wall such that a top edge of said partition wall is lower than a top edge of the r ear portion of the front wall so as to form a top step portion;

said bottom plate is connected to the rear portion of the front wall such that a front edge portion of said bottom plate projects downward from a bottom edge of the front wall so as to form a bottom step portion;

the top step portion of said front wall of said block is adapted to mate with a bottom step portion of a second block disposed on top of said block to prevent said second block from sliding forwards relative to said block; and the bottom step portion of said bottom plate of said block is adapted to mate with a top step portion of a third block disposed under said block so as to suppress said block from sliding forwards relative to said third block.

5. The block as claimed in claim 2, wherein:

said front wall is tapered backward so as to become gradually narrower in width from its front edge to its rear edge.

6. The block as claimed in claim 2, wherein:

said bottom plate is tapered backward so as to become gradually narrower in width from its front edge to its rear edge.

7. A retaining wall of a leaning type comprising:

a plurality of rows of blocks, said rows of blocks being disposed on top of one another, each block comprising a front wall having an upper portion and a lower portion, the front wall leaning gradually in a backward direction from the lower portion to the upper portion, a bottom plate connected integrally to the lower portion of said front wall and extending backward from a rear portion of said front wall, and a partition wall extending vertically and integrally along the rear portion of the front wall, a bottom side of the partition wall being disposed integrally with the bottom plate;

wherein at least one of the front wall and the partition wall is provided with an opening which extends vertically over an entire length thereof and into which a reinforcement rod is disposed;

wherein a first set of rods is embedded inside the front wall in vertical and transverse directions;

wherein a second set of rods is embedded inside the partition wall in vertical and transverse directions;

wherein a third set of rods is embedded inside the bottom plate;

wherein, for each block, the partition wall is connected to the rear portion of the front wall such that a top edge of the partition wall is lower than a top edge of the rear portion of the front wall so as to form a top step portion and the bottom plate is connected to the rear portion of the front wall such that a front edge portion of the bottom plate projects downward from a bottom edge of the front wall so as to form a bottom step portion; and wherein the top step portion of a block in a lower row is adapted to mate with a bottom step portion of a block in an upper row disposed on top of the block in the lower row to prevent the blocking the upper row from sliding forwards relative to the block in the lower row.

8. A method for the preparation of a block comprising a front wall having an upper portion and a lower portion, the front wall leaning gradually in a backward direction from the lower portion to the upper portion, a bottom plate connected integrally to the lower portion of said front wall and extending backward from a rear portion of said front wall, and a partition wall extending vertically and integrally along the rear portion of said front wall, a bottom side of said partition wall being disposed integrally with said bottom plate, wherein at least one of said front wall and said partition wall is provided with an opening which extends vertically over an entire length thereof and which is adapted to receive a reinforcement rod therein, wherein a first set of rods is embedded inside said front wall in vertical and transverse directions, wherein a second set of rods is embedded inside said partition wall in vertical and transverse directions, and wherein a third set of rods is embedded inside said bottom plate, said method comprising the steps of:

pouring a partial amount of a material for structuring said block into a mold;

disposing said reinforcement rod in said material; and pouring another partial amount of said material into the mold.

9. A method for the construction of a retaining wall of a leaning type with a plurality of rows of blocks, said rows of blocks being disposed on top of one another, each block comprising a front wall having an upper portion and a lower portion, the front wall leaning gradually in a backward direction from the lower portion to the upper portion, a bottom plate connected integrally to the lower portion of said front wall and extending backward form a rear portion of said front wall, and a partition wall extending vertically and integrally along the rear portion of the front wall, a bottom side of the partition wall being disposed integrally with the bottom plate, wherein at least one of the front wall and the partition wall is provided with an opening which extends vertically over an entire length thereof and which is adapted to receive a reinforcement member therein, wherein a first set of rods is embedded inside the front wall in vertical and transverse directions, wherein a second set of rods is embedded inside the partition wall in vertical and transverse directions, wherein a third set of rods is embedded inside the bottom plate, wherein, for each block, the partition wall is connected to the rear portion of the front wall such that a top edge of the partition wall is lower than a top edge of the rear portion of the front wall so as to form a top step portion and the bottom plate is connected to the rear portion of the front wall such that a front edge portion of the bottom plate projects downward from a bottom edge of the front wall so as to form a bottom step portion, and wherein the top step portion of a blocking a lower row is adapted to mate with a bottom step portion of a block in an upper row disposed on top of the block in the lower row to prevent the block in the upper row from sliding forwards, said method comprising the steps of:

forming a footing foundation at a construction site where said retaining wall is constructed;

laying a lowest row of said blocks onto an upper rear surface of the footing foundation;

laying an upper row of said blocks onto the lowest row of said blocks;

laying another row said blocks onto the lower row of said blocks; and laying a further row of said blocks onto the another row of said blocks.

10. The method for the construction of a retaining wall as claimed in claim 9, further comprising the steps of:

disposing the reinforcement member into said opening; and filling a filling and solidifying material in said opening.

11. The method for the construction of a retaining wall as claimed in claim 9, wherein the steps of laying an upper row of said blocks onto a lower row of said blocks includes the step of staggering the upper row of said blocks onto the lower row of said blocks.

12. The method for the construction of a retaining wall as claimed in claim 9, wherein said blocks laid in a lower row are smaller in size than said blocks laid in an upper row.

* * * * *